US009457999B2

(12) United States Patent
Belotti et al.

(10) Patent No.: US 9,457,999 B2
(45) Date of Patent: Oct. 4, 2016

(54) COLLAPSIBLE PALLET PICKING ADAPTER

(71) Applicants: John Belotti, Bay City, MI (US); Mark A. Romo, Holly, MI (US); Greg Ecker, Midland, MI (US); James Gage, East Tawas, MI (US); Christopher J Guoan, Alger, MI (US); Stuart J Shellenbarger, Hale, MI (US)

(72) Inventors: John Belotti, Bay City, MI (US); Mark A. Romo, Holly, MI (US); Greg Ecker, Midland, MI (US); James Gage, East Tawas, MI (US); Christopher J Guoan, Alger, MI (US); Stuart J Shellenbarger, Hale, MI (US)

(73) Assignee: Magline, Inc., Standish, MI (US)

( * ) Notice: Subject to any disclaimer, the term of this patent is extended or adjusted under 35 U.S.C. 154(b) by 138 days.

(21) Appl. No.: 14/496,018

(22) Filed: Sep. 25, 2014

(65) Prior Publication Data

US 2016/0090286 A1 Mar. 31, 2016

(51) Int. Cl.
*B66F 9/12* (2006.01)
*B66F 9/16* (2006.01)

(52) U.S. Cl.
CPC *B66F 9/12* (2013.01); *B66F 9/165* (2013.01)

(58) Field of Classification Search
CPC ..... B66F 9/12; B66F 9/125; B66F 9/127; B66F 9/144; B66F 9/165
USPC ..... 414/607
See application file for complete search history.

(56) References Cited

U.S. PATENT DOCUMENTS 2,639,051 A * 5/1953 Thomas ..... B66F 9/195 198/738
2,698,698 A * 1/1955 Smith ..... B66F 9/16 414/607
3,477,600 A * 11/1969 Sawyer ..... B66F 9/16 414/607
3,758,075 A * 9/1973 Briggs ..... B62B 3/06 254/2 R
4,239,446 A * 12/1980 Vucinic ..... B66F 9/12 414/607
4,300,867 A * 11/1981 Frees ..... B66F 9/195 414/493
4,395,189 A * 7/1983 Munten ..... B66F 9/08 187/234
4,422,819 A * 12/1983 Guest ..... E02F 3/401 37/406
4,632,627 A * 12/1986 Swallows ..... B25H 1/16 187/231
4,708,576 A * 11/1987 Conley ..... B66F 9/12 414/607
5,073,077 A * 12/1991 Altman ..... B66F 9/10 414/11
5,207,439 A * 5/1993 Mortenson ..... B62B 1/002 280/47.2
5,897,286 A * 4/1999 Whittaker ..... B66F 9/12 187/237
6,033,177 A * 3/2000 Kooima ..... B61D 15/00 254/2 R
7,744,335 B1 * 6/2010 Cleary ..... B60L 1/003 187/226
7,865,286 B1 * 1/2011 Hall ..... B66F 9/0755 414/462
8,944,744 B2 * 2/2015 Kleeberger ..... B66F 9/07545 187/222
2013/0202400 A1 * 8/2013 Richard ..... B66F 9/12 414/814
2016/0122077 A1 * 5/2016 Moran ..... B62B 3/06 248/176.3

* cited by examiner

*Primary Examiner* — Patrick Maestri
*Assistant Examiner* — Joseph J Sadlon
(74) *Attorney, Agent, or Firm* — Varnum, Riddering, Schmidt & Howlett LLP

(57) ABSTRACT

A pallet picking adapter (100) is adapted for use with a forklift truck (102). The pallet picking adapter (100) includes a bulkhead (130) attached to a frame of the forklift truck (102). The adapter (100) further comprises a deck system (178) having a pair of deck assemblies (180). The deck assemblies (180) can be stored with the bulkhead (130) in the vertical, upright position. For use, the deck assemblies (180) can be individually lowered so as to rest upon forks (120, 122) of the truck (102). In these operable positions, the deck assemblies (180) can be utilized to transport CooLift pallets (320, 322). When the deck assemblies (180) are in the stored, upright position, the adapter 100 can be utilized to transport conventional pallets of standards sizes.

19 Claims, 25 Drawing Sheets

COLLAPSIBLE PALLET PICKING ADAPTER

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO SEQUENCE LISTING

Not Applicable.

BACKGROUND OF THE INVENTION

1. Field of the Invention

The present invention relates generally to material handling and, more particularly, to a pallet picking adapter which can be selectively positioned so as to function with pallets of a first structural configuration or pallets of second structural configurations. The present invention also provides an operator the capability of use with forklifts, walkie-riders and other material transport vehicles.

2. Background Art

As industrial production has developed during the past centuries, it has been necessary to continue to develop new and improved means for performing functions such as the storage and transport of products throughout facilities of the supply chain. Such activities are commonly referred to as "material handling" functions. In general, material handling equipment refers to equipment that relates to the movement, storage, control and protection of materials, goods and products throughout the processes of manufacturing, distribution, consumption and disposal. Material handling equipment is typically the mechanical equipment involved in the complete system. Such equipment is often separated in four main categories: storage and handling equipment, engineered systems, industrial trucks and bulk material handling. Within the category of industrial trucks are forklift trucks. Such forklift trucks are often referred to as lift trucks, fork trucks, or forklifts. Such forklift trucks were first developed in the later part of the 19th Century. Clark Transmission Manufacturing Company is often referenced as one of the first to develop forklifts that could move and store heavy parts. Near the end of the World War I, industrial trucks were developed in the form of seated counter balanced trucks, often referred to as truck tractors. Development activities with respect to material handling and forklifts in general often occurred during times of labor shortages, such as during World War II. Also, during the 1950s, a new demand for forklifts existed because of the increase in multiple types of products and the necessity of maintaining substantial inventories. Also, as warehouses grew bigger, forklifts had to be designed to reach relatively high altitudes, while maintaining safety and meeting increasingly complex Federal regulations. Today, electronic controls and basic computer systems are often found on forklifts.

There are a number of different types of forklifts that are used for different jobbing. Standard forklifts are often relatively large and durable, and are mainly used in warehouses. Such forklifts will often include centered forks or tines for lifting various types of loads, including those which are maintained on pallets. Many motorized forklifts include a cockpit or seating area with controls for the operator. Other types of motorized forklifts used with pallets are often referred to as "walkie-riders," and do not require an operator to be sitting inside a vehicle for operational control.

Most forklift trucks are adapted to transport pallets. The standard definition of a pallet is a relatively flat transport structure that supports goods in a stable fashion, while being lifted by a forklift or similar device. For many forklift trucks, one pallet is the structural foundation of a unit load which allows handling and storage efficiencies. Goods and shipping containers are often placed on a pallet and secured with strapping, stretch wrap or shrink wrap, for purposes of shipment. While many pallets are wooden, they can also be constructed with plastic, metal, paper and various recycled materials. Advantages and disadvantages exist with respect to each type of pallet, relative to the others.

One problem which exists with respect to today's forklift trucks is that the fork or tine configuration, and other structural configurations associated with the forklift truck, limit use to only a single type of pallet structure. Also, as earlier mentioned, the fork or tine configuration of the forklift truck may also limit use to vertical stacking of the pallets with only a single pallet at each horizontal level. An example of one type of pallet which is used with a particular material handling delivery system is known as the "CooLift" delivery system. The CooLift delivery system employs an easily maneuverable and relatively high capacity hydraulic lifting truck, with integrated plastic "half" pallets, for purposes of improved safety and efficiency. With such a delivery system, the product can be delivered to the store with up to 50% reduction in driver product touches. At a delivery location, drivers can transfer a product to its final destination through a traditional door, unlike with full-sized pallets, as a result of the typical CooLift pallet's compact size.

One issue which arises with respect to efficiency of industrial material handling relates to the use of CooLift pallets. In many standard forklift configurations, the CooLift pallets are not capable of use. That is, they are adapted for only specific types of forklift trucks.

In view of the foregoing, it would be advantageous for an operator to be capable of using a relatively standard truck or walkie-rider with CooLift pallets, while also having the capability of alternatively using the same standard forklift or walkie-rider to transport regular pallets.

SUMMARY OF THE INVENTION

The invention comprises a pallet picking adapter which can be positioned in alternative configurations on a forklift truck or walkie-rider, so as to accommodate both regular pallets and pallets which are known as CooLift pallets. The pallet picking adapter is adapted to be mounted to forklift trucks of various types, where such trucks are comprised of forks, tines or other means for typically supporting pallets. The adapter may include a vertically disposed bulkhead positioned at one end of the adapter. The adapter further comprises at least two decks which are coupled to the bulkhead and are moveable between an upright, vertical orientation to a configuration where the decks are in one or more substantially horizontal planes. One or more latches are provided for releasably securing the decks to the bulkhead of the adapter, when the decks are in their vertical orientation. Each of the decks, through operation of a corresponding latch, can be moved from its vertical orientation to its horizontal orientation.

Advantageously, the pallet picking adapter may include its own bulkhead, which is mountable to the standard forklift truck or walkie-rider with which the adapter will be employed. The decks are each separately pivotable relative to the bulkhead, with the pivot positions being located at or near the lower portions of the bulkhead. To dampen the movement of the decks from their vertical to their horizontal orientations, a linkage system is coupled to the decks with gas springs for purposes of controlling the damping movement. The pivoting functions are provided by pivot blocks connected between the decks and the bulkhead. In accordance with one embodiment of the invention, the decks can be offset vertically from one another. This vertical offset advantageously allows flexibility, when either one or two pallets are being manipulated.

The linkage system which is coupled between the lower portion of the bulkhead and the decks serve to guide and position the length of the deck into appropriate positions, as the deck descends from a vertical orientation to a horizontal orientation. As mentioned, the gas springs (which advantageously may include two per side) will serve to dampen the descent of the decks when they are deployed into the horizontal orientation. Although not incorporated within the embodiments disclosed herein, the gas springs may possibly be utilized for purposes of assisting the operator when moving the decks back into the vertical orientation.

As also earlier stated, the pallet picking adapter is advantageous for use with forklift trucks and walkie-riders which utilize fork tines. Each of the decks includes a U-shaped support section which is positioned toward what can be characterized as the front of each deck. The support section includes a pair of legs which attach to each deck and which extend downwardly when the decks are in the horizontal orientation. A bight section extends transversely across each deck and physically abuts the top portion of the tine when the deck is lowered. Located at the bottom portion of each of the bight sections is an anti-shear component coupled to the bight section in a manner so as to be adjustable along at least a part of the length of the bight section. The anti-shear component includes a cylindrical component which extends downwardly from the bight section when the deck is lowered. The position of the cylinder relative to the bight section is adjusted by the operator so that when the deck is in the horizontal orientation, a side surface of the cylinder abuts the outer side of the associated deck. If desired, a cylindrical anti-shear component can be provided on opposing sides of the bight section and adjustably positioned by the operator so as to abut both outer sides of the associated deck. The sides and positioning of each of the cylindrical components prevents the deck from moving inwardly or outwardly in response to external forces applied so as to impact the sides of the deck. This prevents or at least limits potential damage to the adapter system at the area of pivot connection of the deck to the bulkhead. In this regard, the tines are typically constructed with substantial strength, including substantial resistance against movement upon application of external forces along the sides of the tines. With the tines being relatively immovable, the anti-shear components will of course finally prevent the movement inwardly of the associated decks.

The entirety of the pallet picking adapter can be inwardly mounted to the fork truck or walkie-rider in a number of different ways, without departing from the spirit and scope of the principal concepts of the invention. For example, U-bolts can be mounted so as to couple the bulkhead to truck rails. Such U-bolts can then be fastened with lock nuts or similar components. In addition to the U-bolts, other elements, such as elongated steel connectors having apertures therein can be utilized with bolts and lock nuts in a manner so as to sandwich the equipment rails and the bulkhead together. Bolts, lock nuts and/or similar components can be utilized for connections.

Turning specifically to the language of the claims as defining the invention, the broadest claim defines a pallet adapter assembly for use with a pallet transport vehicle having a pallet lifting frame and a plurality of forks or tines for supporting pallets during transport. The assembly includes an adapter frame releasably secured to the transport vehicle, so that the frame moves vertically in conjunction with the pallet lifting frame. A deck system comprises one or more deck assemblies coupled to the adapter frame and movable between first retracted, stored positions and second extended, operable positions. When the deck assemblies are in the retracted positions, the pallet adapter assembly and the pallet transport vehicle can support and transport standard pallets of conventional sizes. Conversely, when at least one deck assembly is in an operable position, the assembly is positioned above one of the forks and is adapted to support a CooLift pallet during transport.

The deck assemblies include a first deck assembly and second deck assembly. The first deck assembly is movable between the retracted position and the extended position, independent of similar movement of the second deck assembly. The first deck assembly can include an upper deck having an elongated configuration and positionable above a first one of the forks. The second deck assembly can include a second lower deck having an elongated configuration, and positionable over a second one of the forks when the lower deck is in the extended and operable position. In accordance with the invention, when the first upper deck and the second lower deck are both in their extended and operable positions, the first upper deck is vertically offset from the second lower deck, so that the first upper deck is located a predetermined distance above the second lower deck.

The adapter frame can include a bulkhead positioned adjacent to the pallet lifting frame of the transport vehicle. The pallet adapter assembly can further include a linkage system pivotably coupling each of the first and second deck assemblies to the bulkhead. The linkage system can include a first linkage assembly pivotably coupling the first deck assembly to the bulkhead, and a second linkage assembly for coupling the second deck assembly to the bulkhead. Each of the linkage assemblies can include one or more assist mechanisms for controlling and damping pivotable movement of its corresponding deck assembly from the retracted, stored position to the extended, operable position. In accordance with one aspect of the invention, each of the assist mechanisms can include at least one gas spring coupled between a corresponding one of the deck assemblies and the bulkhead.

In accordance with another aspect of the invention, each deck assembly can include one or more anti-shear devices positioned on the corresponding deck assembly and abutting or otherwise adjacent to sides of the corresponding fork on which the deck assembly rests when the deck assembly is in the extended, operable position. Each of the one or more anti-shear devices functions so as to transfer forces applied on one or more sides of a deck from potential shearing forces against one or more of the deck sides to lateral forces applied against one or more sides of the corresponding fork. One or more of the anti-shear devices is connected to a corresponding one of the deck assemblies, so that the device is laterally adjustable a predetermined length relative to the position of the deck assembly when in the extended, operable position.

More specifically, each deck assembly can be characterized as comprising at least one anti-shear device positioned on said corresponding deck assembly and abutting or otherwise adjacent to a side of the corresponding fork on which the deck assembly rests when the deck assembly is in the extended, operable position. Further, and more explicitly, each of the anti-shear devices functions so as to transfer forces applied on at least one side of a deck from potential shearing forces to lateral forces applied to the corresponding fork. Still further, at least one of the anti-shear devices is connected to a corresponding one of said deck assemblies so that the device is laterally adjustable a predetermined length relative to the position of the deck assembly when in the extended, operable position.

Further, and in accordance with other aspects of the invention, each deck assembly can be characterized as comprising an anti-shear device positioned on said corresponding deck assembly and abutting or otherwise adjacent to an outer side of the corresponding fork on which the deck assembly rests when the deck assembly is in the extended, operable position. In accordance with yet another aspect of the invention, each deck assembly comprises at least two anti-shear devices, with at least one of the devices being positioned adjacent an outer side of the corresponding fork, and another of the at least two anti-shear devices positioned adjacent the inner side of the corresponding fork.

As earlier stated, the adapter frame can include a bulkhead which is vertically oriented and positioned at a rear portion of the adapter assembly. When each of the deck assemblies is in a retracted, stored position, the deck assembly is essentially folded into the bulkhead. The adapter further comprises a latching system for releasably securing the deck assemblies to the bulkhead in their retracted, stored positions. The latch system includes first and second latch mechanisms being associated with corresponding ones of the deck assemblies and positionable across an upper portion of the bulkhead, and manually operable by a user.

With the adapter frame comprising a vertically oriented bulkhead, the transport vehicle can comprise frame components positioned adjacent the bulkhead. The adapter assembly can further comprise a connector system for releasably securing the bulkhead to the pallet lifting frame. Further, the pallet transport vehicle can comprise a standard forklift truck. Alternatively, the pallet transport vehicle can comprise a walkie-rider.

BRIEF DESCRIPTION OF THE SEVERAL VIEW OF THE DRAWINGS

The invention will now be described with respect to the drawing, in which.

Figure 18:
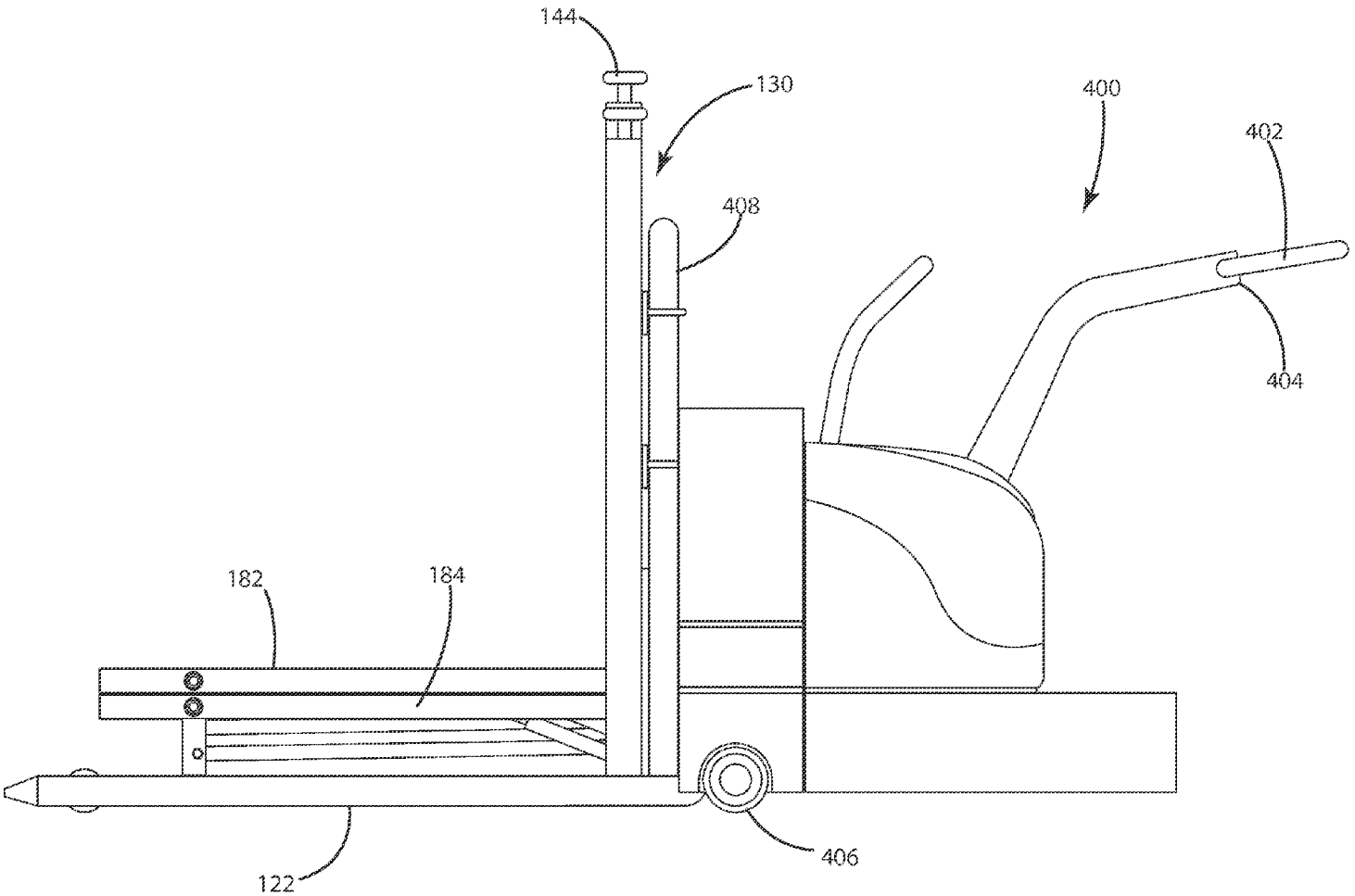
FIG. 18 is a side, elevation view of the pallet picking adapter and walkie-rider shown in FIG. 16.
Figure 19:
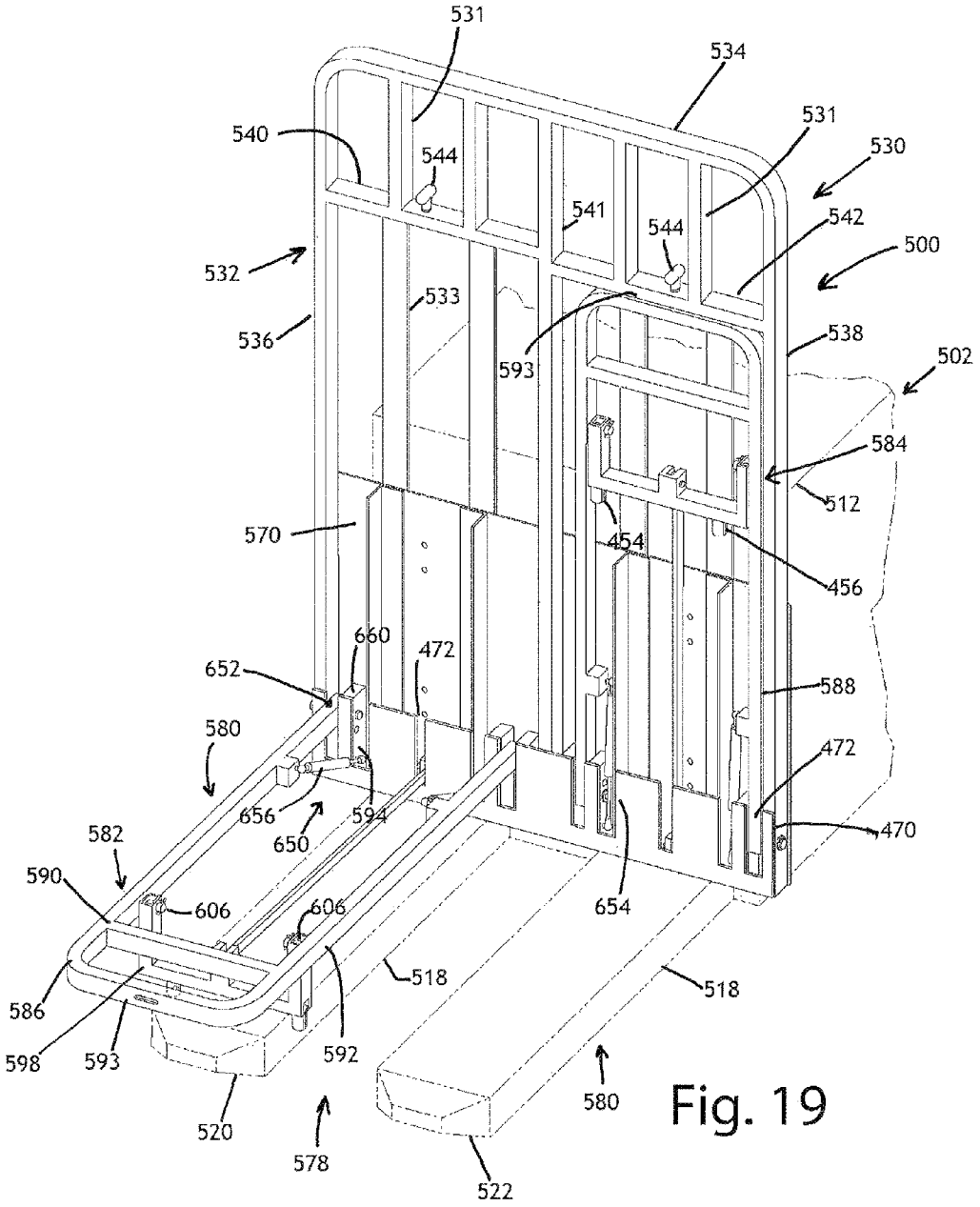
Figure 20:
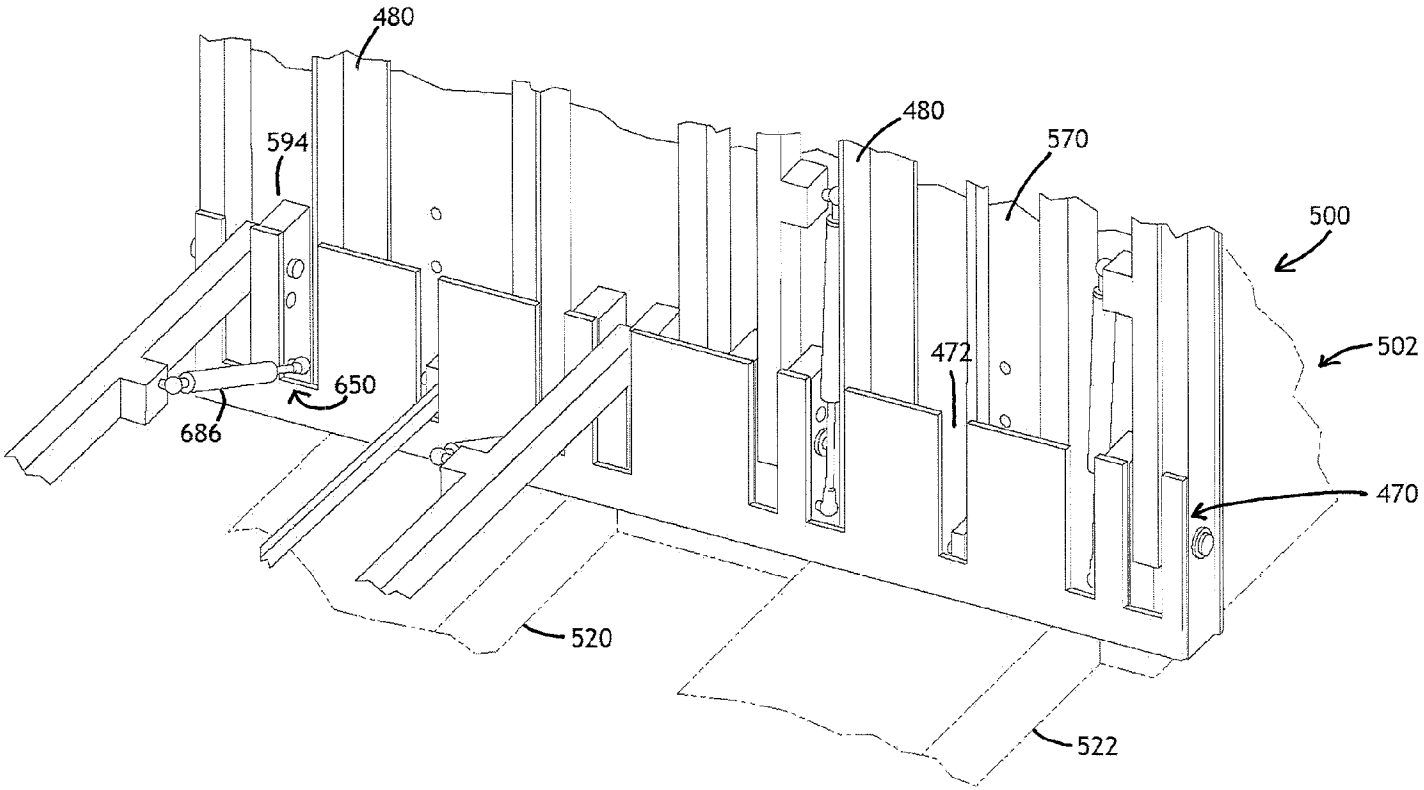
Figure 21:
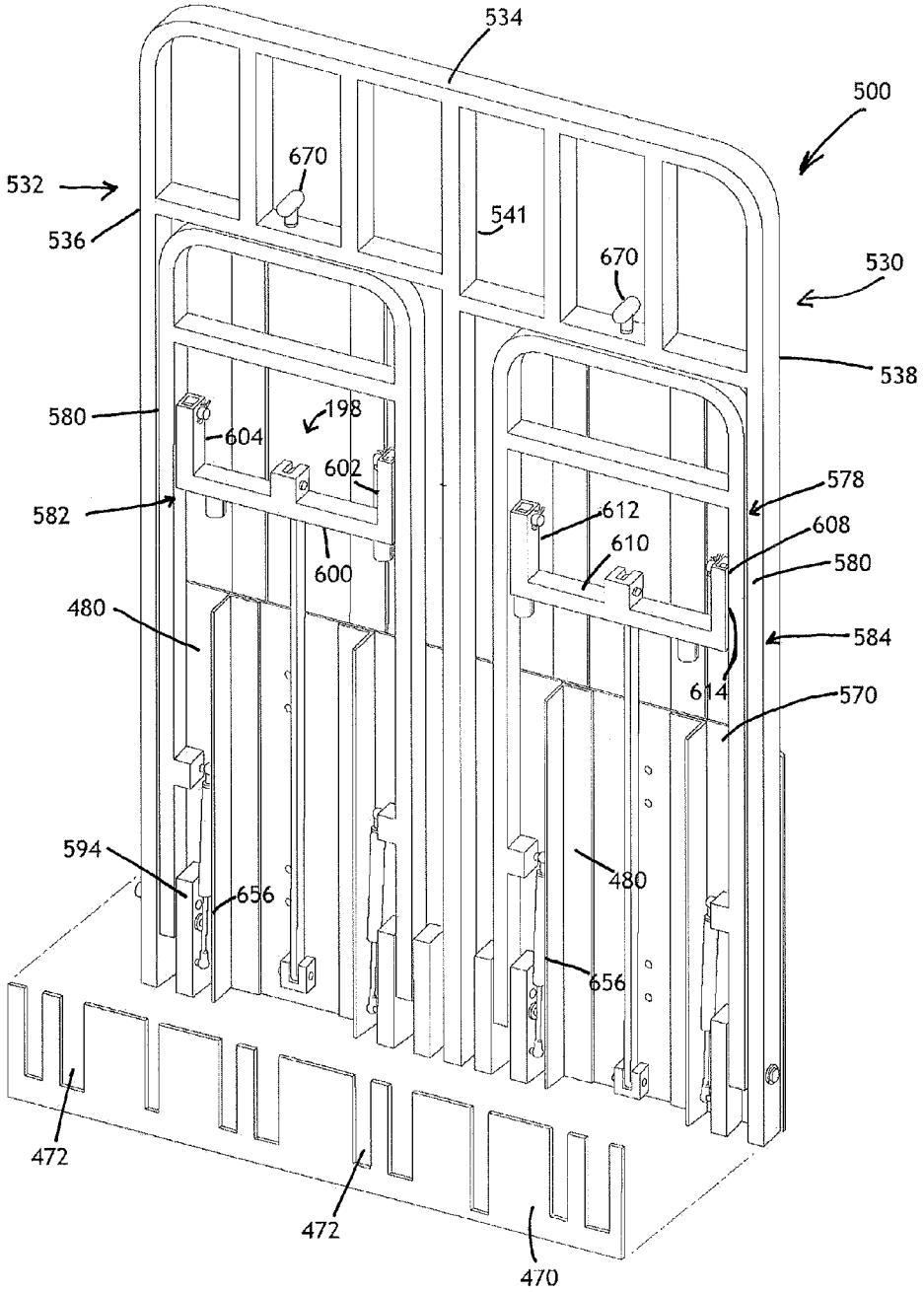
Figure 22:
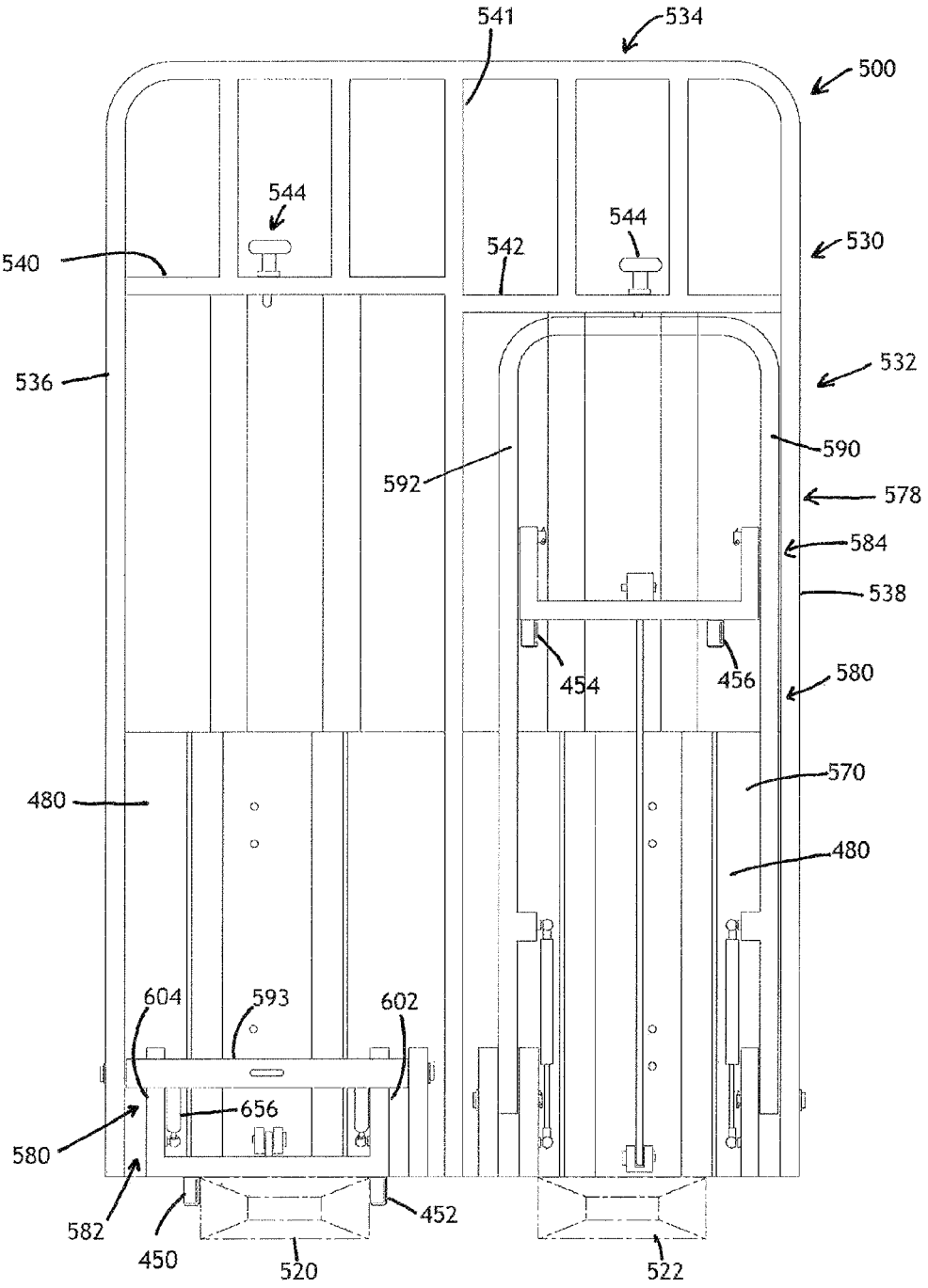
Figures 23, 24:
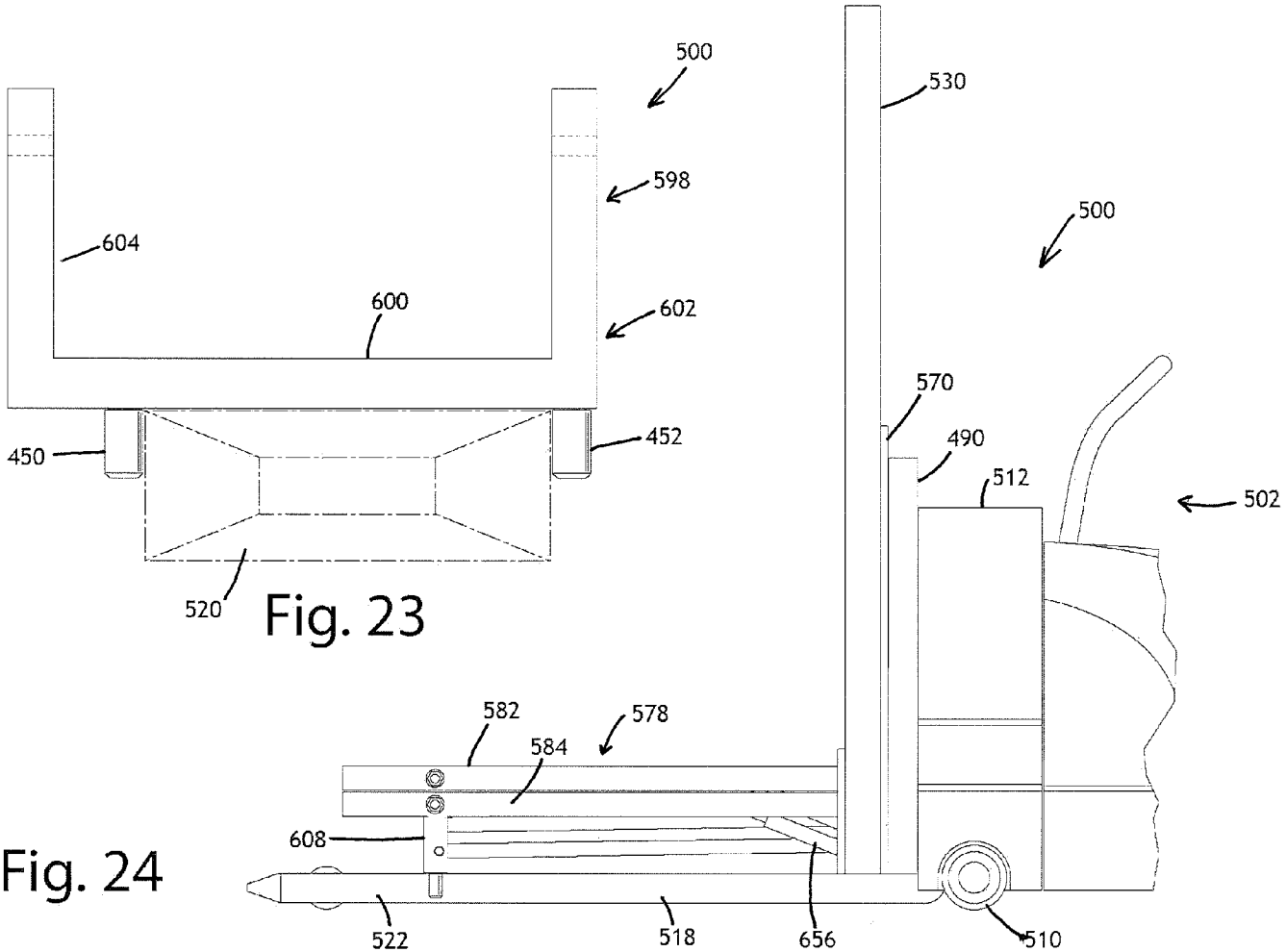

FIG. 19 is a partial, perspective illustration of a further embodiment of a collapsible pallet picking adapter, showing certain additional and/or substitute concepts in accordance with the invention, relative to the embodiment shown in FIGS. 1-18, FIG. 19 specifically illustrating an increased bulkhead or backrest height, an increased height in a lower plate, the addition of transverse bars offset and positioned below an upper bight section of the bulkhead, with latches being positioned on the transverse bars, and a lower kick plate positioned opposite to the lower plate, and a variation in structure associated with the anti-shear components;

FIG. 20 is a partial perspective view showing a relatively more detailed illustration of the kick plate associated with the embodiment of FIG. 19, and further showing the lower portion of the lower plate, along with the lower portion of vertical support strips attached to or otherwise integral with the lower plate;

FIG. 21 is a partial exploded view showing the kick plate of FIGS. 19 and 20 in an exploded configuration relative to the bulkhead, the relative extended height of the lower plate, upper extension of the bulkhead, the positioning of the latches on a set of transverse bars below the upper most portion of the bulkhead, and with the decks positioned in their vertical, upright configurations;

FIG. 22 is a front elevation view of the embodiment shown in FIG. 19, with the kick plate removed, and showing one of the decks in a lowered position and one of the decks in a vertical, upright position;

FIG. 23 is a partial, elevation view in an enlarged format, showing the relative positioning of the anti-shear components as associated with a corresponding tine or fork; and FIG. 24 is a side, elevation view, showing both the decks in a lowered, horizontal configuration, and showing, as does FIG. 21, the concept of including a plate skeleton for purposes of providing for a somewhat universal mount to a Walkie-Rider.

DETAILED DESCRIPTION OF THE INVENTION

The principles of the invention are disclosed, by way of example, with respect to a pallet picking adapter 100 as illustrated in FIGS. 1-18, and further in a second embodiment of a pallet picking adapter 500 as illustrated in FIGS. 19-24. The inventors believe, at the time of preparation of this application directed to the invention, that pallet picking adapter 500 incorporates certain concepts which may be considered preferred embodiments of the invention. It should be noted that the title of this document identifies the invention as a "collapsible" pallet picking adapter. However, although certain features of the invention specifically relate to collapsible functions of certain elements of the invention, other features do not. Accordingly, the embodiments of the invention are described herein without necessarily referring to the embodiments as being collapsible.

The pallet picking adapter 100 will first be described in detail, and pallet picking adapter 500 will be described in subsequent paragraphs herein. Many of the elements of pallet picking adapter 500 correspond in both structure and function to corresponding elements of pallet picking adapter 100. Accordingly, such elements of pallet picking adapter 500 will not be described in detail as extensive as the detailed description of the same elements in pallet picking adapter 100. The immediately following paragraphs describe pallet picking adapter 100.

The pallet picking adapter 100 is advantageously designed so as to be used with pallets which are often referred to in the industry as "CooLift pallets". Of particular advantage, the pallet picking adapter 100 can be used not only with CooLift pallets, but also with conventional pallets, without requiring any redesigns or changes in configurations. Further, the pallet picking adapter 100 is advantageously used with various types of forklift trucks and walkie-riders, again without any need for reconfiguration. Still further, the pallet picking adapter 100 employs manually operable decks which can be moved between lowered or extended positions for use with CooLift pallets, and alternatively maintained in an upwardly folded or retracted position when used to transport regular pallets. In addition, such regular pallets can be of various standard sizes (e.g., 36"×36", or 48"×48"), and can be constructed of various materials (wood, plastic and the like).

As explained in greater detail in subsequent paragraphs herein, the pallet picking adapter 100 can employ two decks movable between folded or retracted positions, and horizontal or extended positions. Manual operation can be achieved through the use of one or more releasable latches for securing and releasing the decks from the retracted or folded positions.

In addition to the foregoing, another concept disclosed in the pallet picking adapter 100 is the use of offset decks. That is, the decks can be vertically offset for purposes of allowing flexibility when manipulating one or two of the CooLift pallets. In this regard, it should be noted that the decks can advantageously be folded up or down independent of one another.

In accordance with other aspects of the invention, the pallet picking adapter 100 includes its own bulkhead. Pivot components can be welded or otherwise coupled to the bulkhead. These pivot components can include coupling to the decks, gas springs for purposes of damping movement of the decks, and the mounting configuration for a linkage system between the bulkhead and the decks.

The pallet picking adapter 100 can be removably mounted onto a forklift truck or walkie-rider in any of several ways, depending upon the structure of the forklift or walkie-rider, and the needs of the operator.

Figure 1:
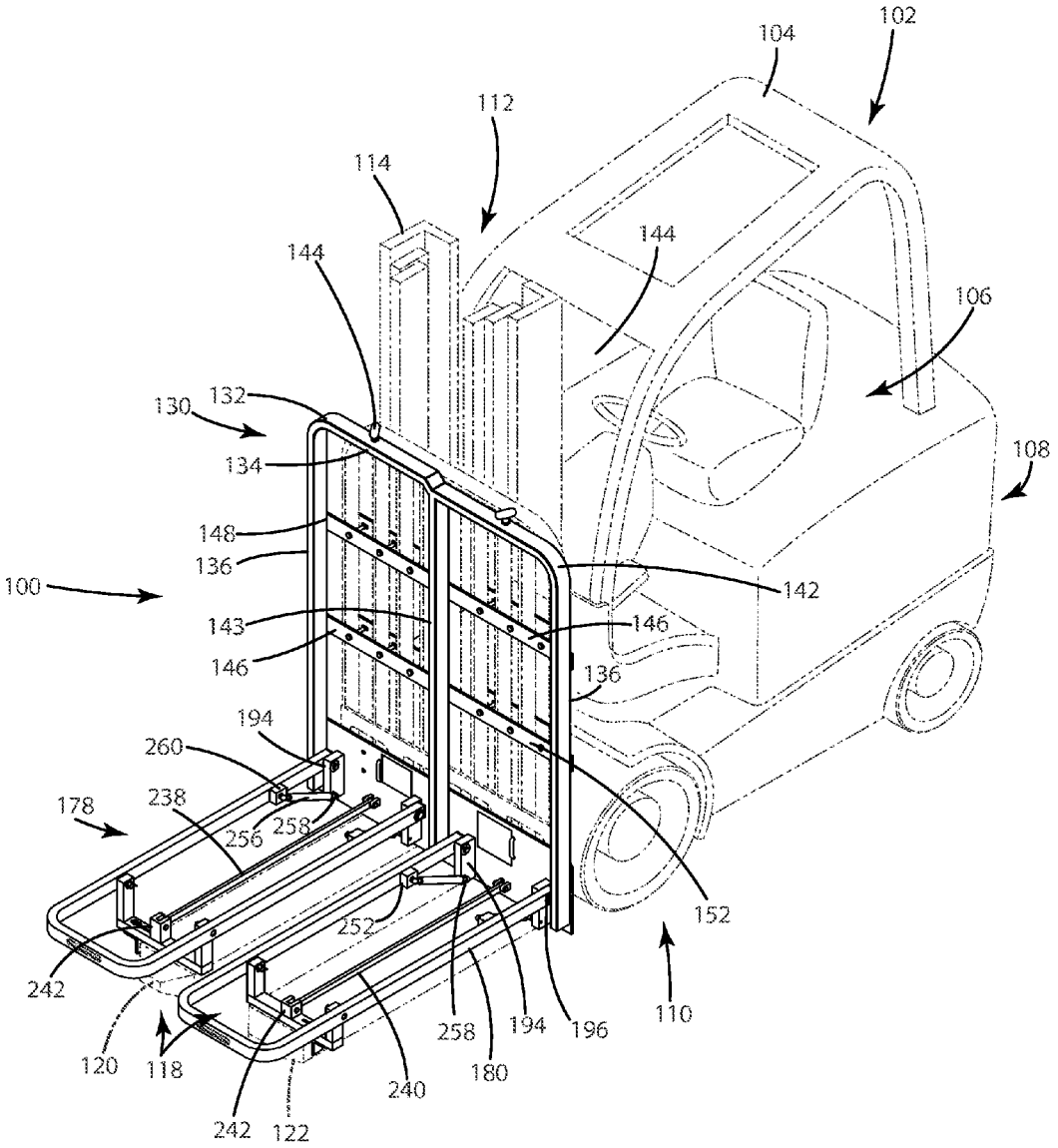
FIG. 1 is a perspective view of one embodiment of a pallet picking adapter in accordance with the invention, with the adapter being shown mounted to a forklift truck, and with the forklift truck being shown in phantom line format.
Figure 2:
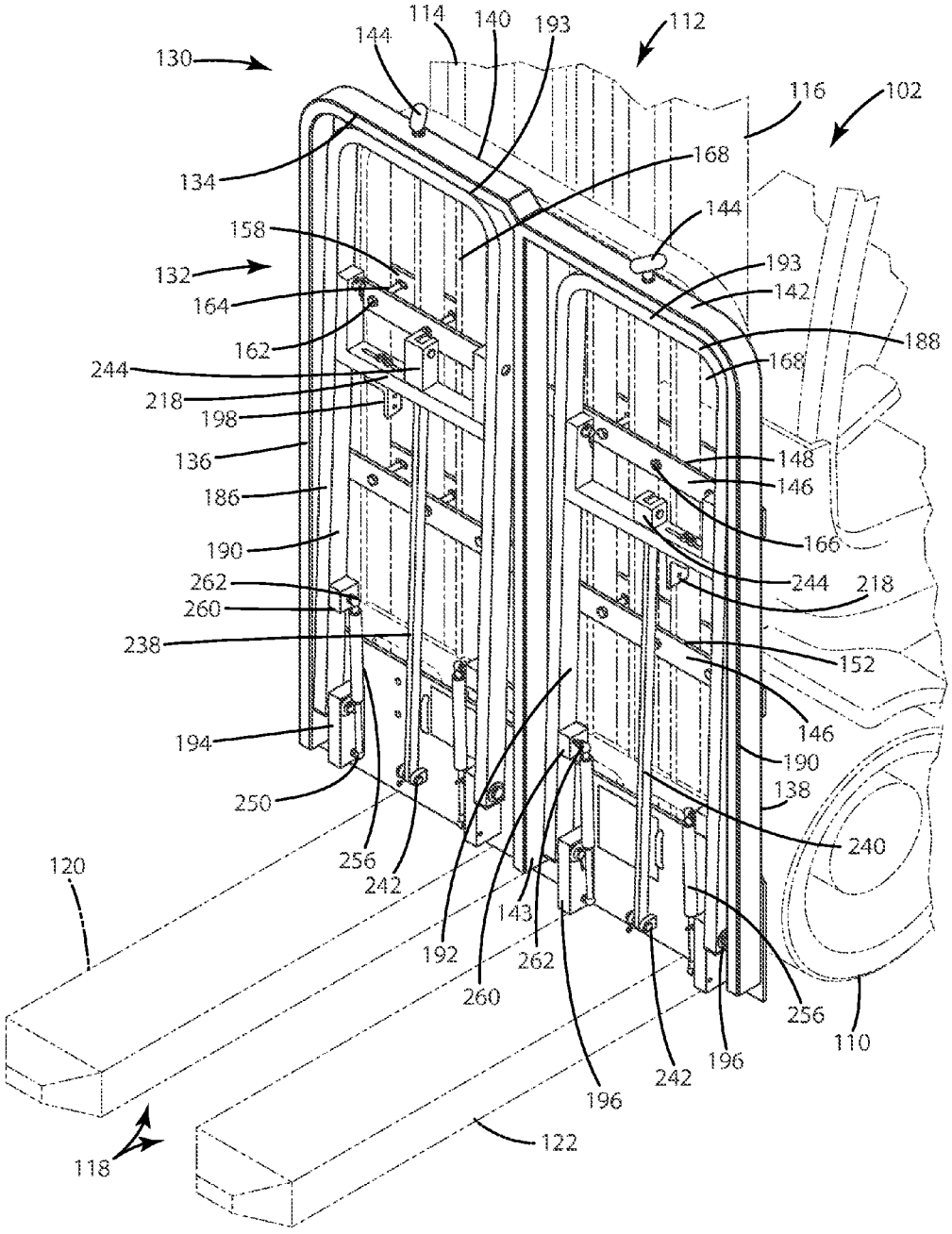
FIG. 2 is a perspective view of the pallet picking adapter shown in FIG. 1, with the decks positioned in their vertical orientations, and latched to a bulkhead of the adapter.

The pallet picking adapter 100 includes other concepts in accordance with certain aspects of the invention, as will be described in greater detail. For example, the adapter 100 includes anti-shear components which can be utilized to prevent or otherwise limit damage to the adapter system and the pivot areas of the decks, which could otherwise result from substantial side impact forces being applied to the deck. The anti-shear components are advantageously adjustable, for purposes of accommodating varying widths of forks and tines. Turning specifically to FIGS. 1 and 2, and particularly FIG. 1, the pallet picking adapter 100 is illustrated as releasably connected to a conventional forklift truck 102. As earlier stated, the pallet picking adapter 100 and other adapters in accordance with the invention can be utilized with various types and sizes of commercial forklift trucks, as well as walkie-riders and other material handling vehicles. In FIG. 1, the conventional forklift truck is identified as truck 102. The truck 102 may include, for example, an overhead guard 104 covering a cockpit 106 where an operator may sit and manipulate various controls. The cockpit 106 sits on a body 108. For a conventional forklift truck, it is not uncommon for the body 108 to encompass a counter weight or the like (not shown) at the rear portion of the body 108.

The truck 102 may also include conventional wheels 110, and a forward positioned hydraulic hoist ram 112. In the particular example shown in FIG. 1, the hoist ram 112 may include a first upper hoist arm 114 and a second upper hoist arm 116. Extending substantially horizontal and forward of the hoist ram 112 are a pair of forks or tines 118 having an elongated configuration, and shown with relative clarity in FIG. 2. The fork pair 118 may include a first fork 120 and second fork 122. The hoist ram 112, fork pair 118, and other components of the truck 102 can substantially vary in design and configuration, without departing from any of the novel concepts of the invention.

Details associated with the pallet picking adapter 100 will now be described primarily with respect to FIGS. 1-10. The pallet picking adapter 100 can be characterized as comprising several main components. With reference primarily to FIGS. 1-4, these components include a bulkhead 130, deck assemblies 180, and linkage systems 250. The bulkhead 130 is a vertical upstanding component which is used to couple the pallet picking adapter 100 to the forklift truck 102 (or other type of truck or walkie-rider), and to provide a vertical storage support for the deck assemblies 180 when not in use, as well as to provide a support for pivotal movement and positioning of the deck assemblies 180 in a horizontal orientation when in use.

Figure 3:
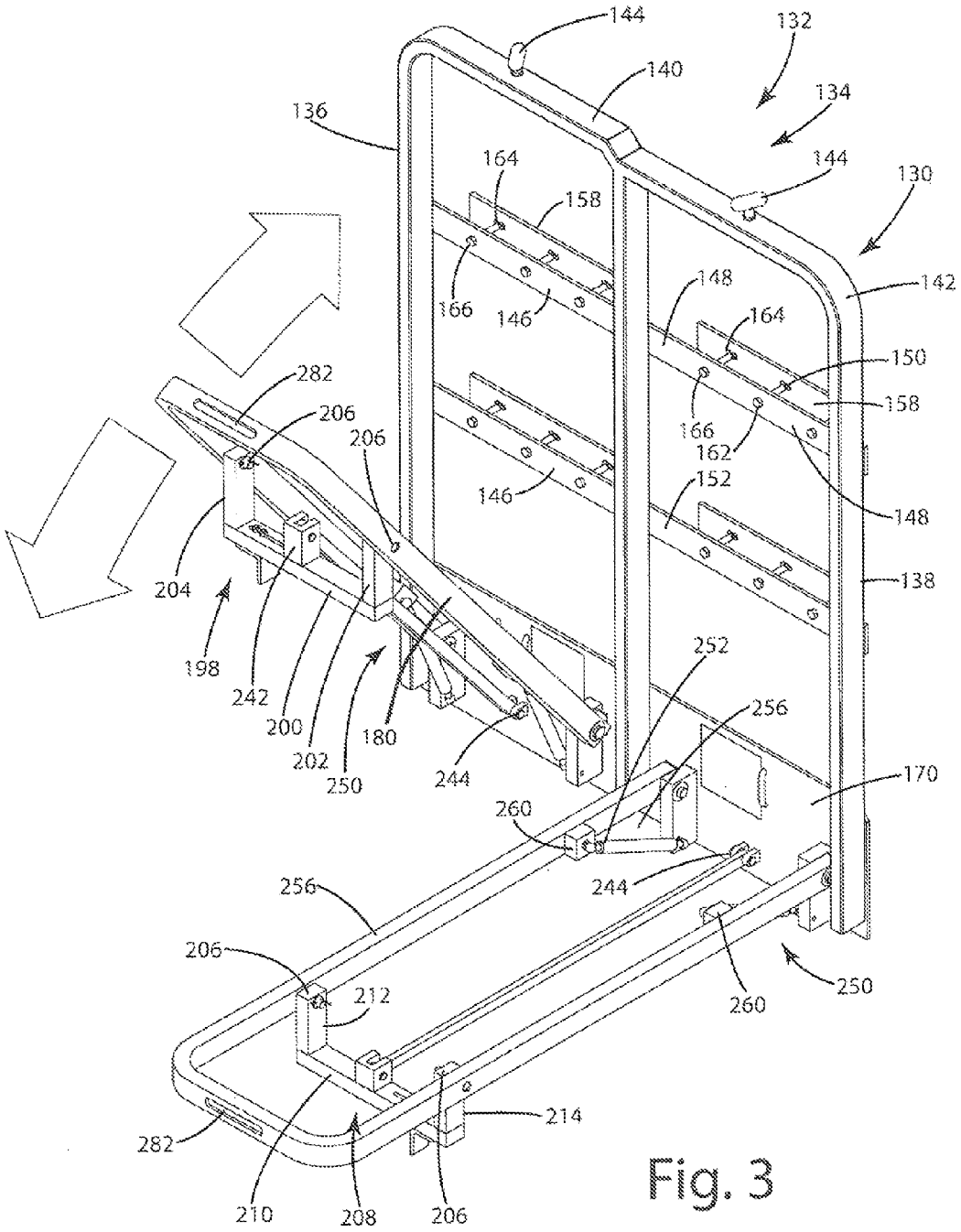
FIG. 3 is a perspective illustration showing the adapter of FIG. 1 in a standalone format (absent the forklift truck), and showing one deck in a horizontal orientation, and the other deck in intermediate position spaced between its vertical orientation coupled with the bulkhead, and its horizontal orientation.
Figure 4:
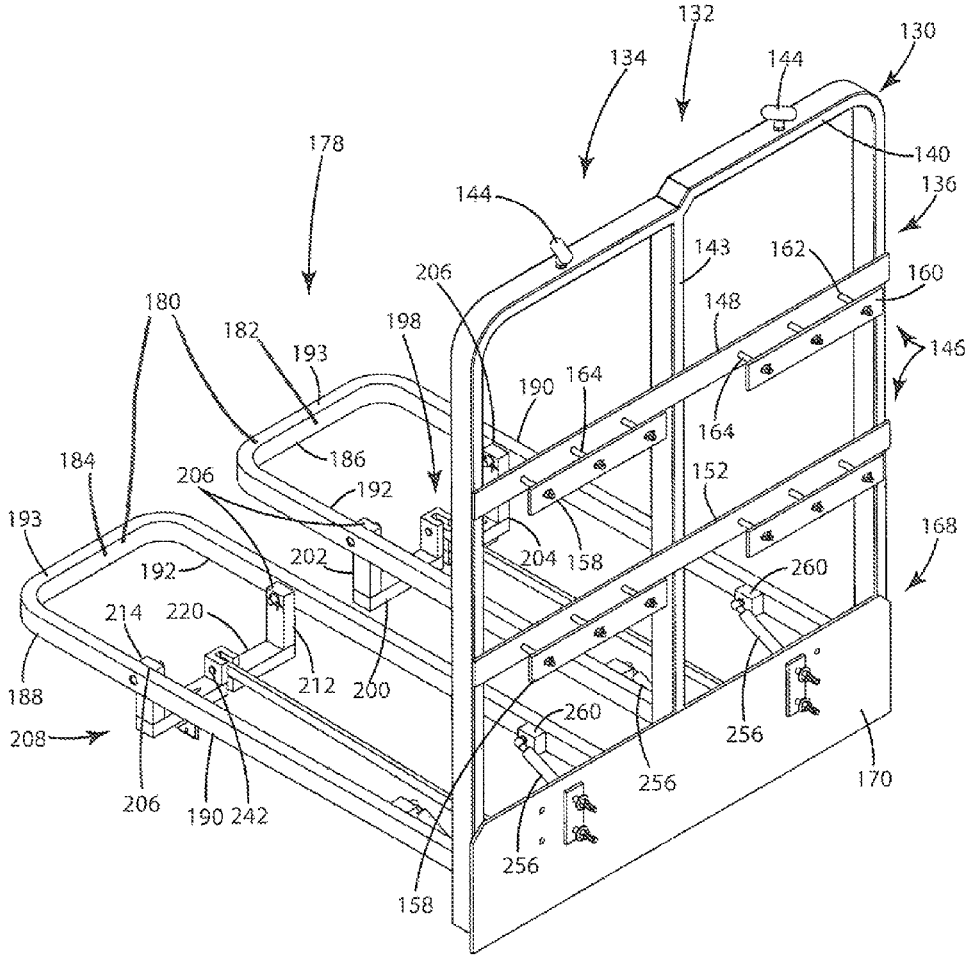
FIG. 4 is a right side and rear, perspective view of the pallet picking adapter shown in FIG. 1, and showing both of the decks in their horizontal orientations.

With respect in particular to FIGS. 3 and 4, the bulkhead 130 includes an inverted U-shaped outer frame 132 which can be constructed of various types of materials. The inverted outer frame 132 can include an upper bight section 134 which extends transversely across the adapter 100. The upper bight section 134 can comprise a first side leg 136 extending vertically downward from one end of the bight section 134, and a second side leg 138 extending vertically downward from an opposing end of the upper bight section 134. The bight section 134, first side leg 136 and second side leg 138 may be integral with each other. Further, the upper bight section 134 can be separated into two sections. The sections comprise a raised first bight half-section 140 which may be integral with the first side leg 136, and a second bight half-section 142 integral with the second side leg 138. As apparent from several of the drawings, including FIGS. 3 and 4, the first bight half-section 140 is raised above the second bight half-section 142. The reason for this configuration is to accommodate one of the decks 186 being raised and offset from the other of the decks 188, while still maintaining each of the decks 186, 188 with the same length as the other of the decks 188, 186. The function of this vertical offset will be described in greater detail in subsequent paragraphs herein. In addition to the legs 136, 138 of the U-shaped outer frame 132, the bulkhead 130 also includes a central vertical leg 143 which extends downwardly from the intersection of the bight half-sections 142. The central vertical leg 143 has an elongated configuration, with a length substantially corresponding to the length of the second side leg 138.

The bulkhead 130 also includes a pair of latch assemblies 144. The latch assemblies 144 are located on the bight half-sections 140 and 142 and extend upwardly therefrom. As will be described in subsequent paragraphs herein, the latch assemblies can include various configurations, including assemblies comprising spring plungers and knobs. The functions of the latch assemblies are to provide releasable and securable coupling of the decks 186, 188 to the bulkhead 130 when in their refracted or unused positions.

For purposes of support and coupling of the bulkhead 130 to the forklift truck 102, a pair of transverse connector brackets 146 are provided. The transverse connector brackets 146 may preferably be welded or otherwise connected to the rear portions of the side legs 136, 138 and central bulkhead leg 143. The transverse connector brackets 146 include an upper transverse connector bracket 148. Positioned below the upper transverse connector bracket 148 is a central transverse connector bracket 152. The details of the transverse connector brackets 146 are particularly shown in FIG. 4 and in the exploded view of FIG. 5. For purposes of securing the bulkhead 130 to frame components of the forklift truck 102, the connector brackets 146 can be utilized in conjunction with a series of locking plates 158. The locking plates 158 are particularly shown in FIGS. 4 and 5, and have an elongated configuration with apertures 160 extending therethrough. The locking plates 158 can be constructed so that the apertures 160 therein mate with corresponding apertures 162 located in the transverse connector brackets 146. Further, however, the apertures 162 in the connector brackets 146 may, as shown in FIG. 5, be in the form of slots rather than circular holes, so as to provide some lateral adjustment of the relative positions of the connector brackets 146 to the locking plates 158.

Figure 5:
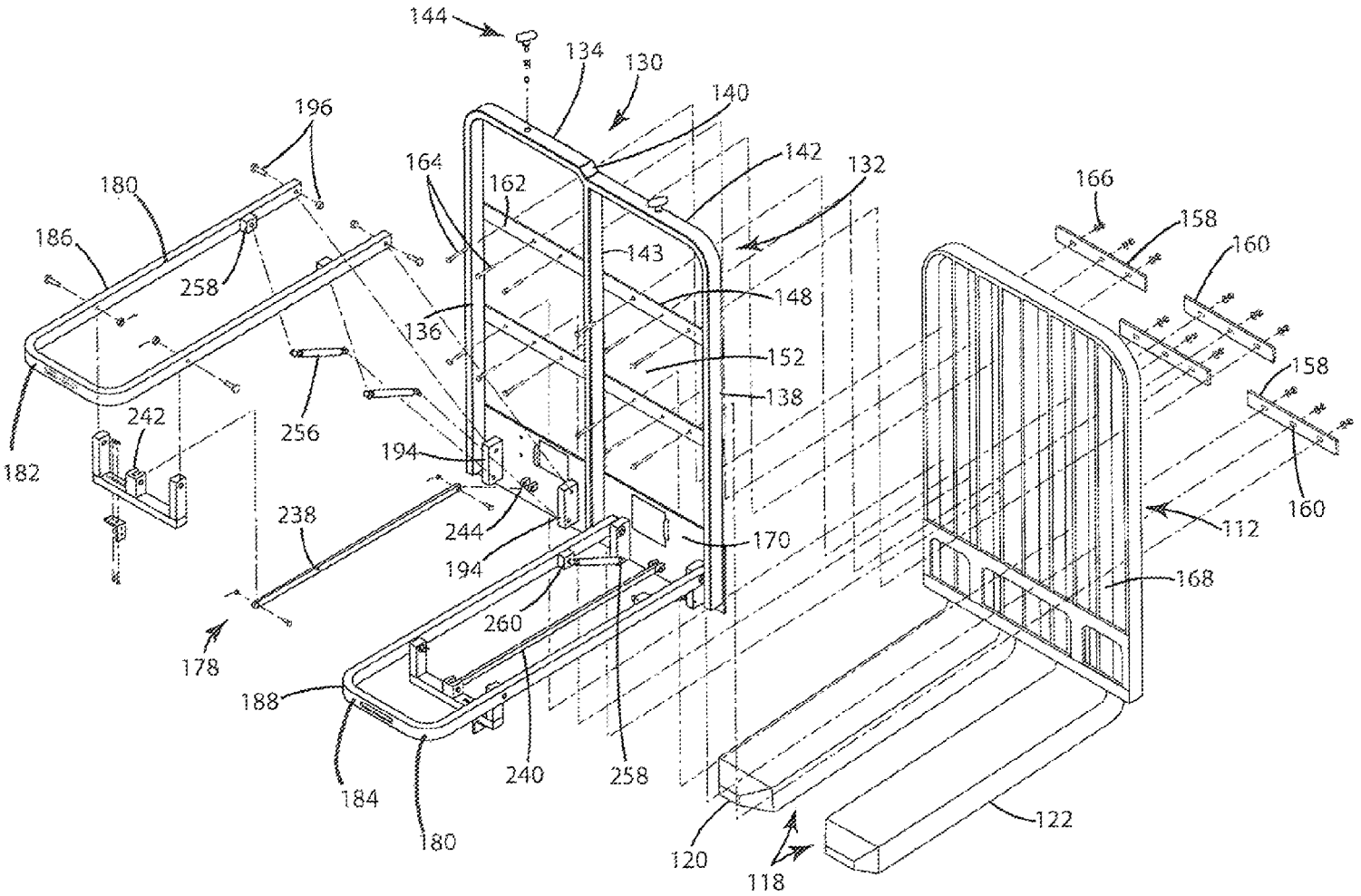
FIG. 5 is an exploded view of the pallet picking adapter shown in FIG. 1, showing various components of a deck separate from the bulkhead, with an additional illustration of a pair of forks or tines of the forklift trucks, as well as the vertical forklift frame and a connection arrangement using elongated connectors.

As particularly shown in FIG. 5, the connector brackets 146 and locking plates 148 can be configured so as to "capture" components associated with the hoist arms 112 of the forklift truck 102. Alternatively, additional vertical frame components 168 can be located on the vertical portion of the lift frame of the forklift truck 102, as shown in FIG. 5. The locking plates 158 can then be positioned relative to the connector brackets 146 so as to capture the frame components 168. The locking plates 158 and the connector brackets 146 can be secured by conventional bolts 164 and nuts 166 as shown in FIG. 5.

In addition to the connector brackets 146 and locking plates 148, the bulkhead 130 includes a lower plate 170. The lower plate 170 is particularly shown in FIG. 4. The lower plate 170 extends transversely across the bottom of the U-shaped outer frame 132 and is positioned on the side of the bulkhead 130 adjacent to the forklift truck 102. The lower plate 170 may be welded to the lower portions of the legs 136 and 138, and the central vertical leg 143. However, the lower plate 170 can be secured to the vertical frame of the bulkhead 130 by any other suitable securing means. The lower plate 170, as will be descried in subsequent paragraphs herein, serves to provide for a "base" for components comprising deck assemblies and linkage systems of the pallet picking adapter 100.

In addition to the bulkhead 130, the pallet picking adapter 100 in accordance with the invention includes a deck system 178. The deck system is shown in a number of the drawings, particularly with respect to FIGS. 1-7. The deck system 178 comprises a pair of deck assemblies 180 particularly shown in a lower position in FIGS. 1 and 4. The pair of deck assemblies 180 comprise a first upper deck assembly 182 and a second lower deck assembly 184. As will be apparent from the description herein, when the deck assemblies 180 are positioned in an upright or "folded up" configuration, the forklift truck 102 can be used to transport regular pallets of various standard sizes and composed of various materials. Conversely, when the deck assemblies 180 are in a lowered position (as shown in FIGS. 1 and 4), the forklift truck 102 can then be used to transport CooLift pallets. If desired, separate pallets can be simultaneously transported on the separate ones of the deck assemblies 180.

The first upper deck assembly 182 comprises a first U-shaped deck 186. Correspondingly, the second lower deck assembly 184 includes a second U-shaped deck 188. The decks 186 and 188 are similar to each other, and are particularly shown in their lower positions in FIGS. 1 and 4. The first U-shaped deck 186 includes a first outer leg 190 extending (when the deck 186 is in the lower position) from the terminal end of the deck to the bulkhead 130. Correspondingly, the deck 186 also includes a second inner leg 192 extending parallel to the first outer leg 190. A transverse bight portion 193 connects the terminal ends of the legs 190, 192.

Correspondingly, the second U-shaped deck 188 also includes a first outer leg 190 and second inner leg 192. Further, a transverse bight portion 193 extends between the terminal ends of the legs 190, 192.

The legs 190, 192 of each of the decks 186, 188 are pivotably coupled to the lower portions of the bulkhead 130 through a set of pivot blocks 194. The pivot blocks are particularly shown in FIGS. 1, 2 and 5. Pivot connector bolts 196 (primarily shown in FIG. 5) are used to couple the ends of the legs 190, 192 to the pivot blocks 194.

Associated with the deck system 178 and particularly with respect to the first upper deck assembly 182 is a component which can be characterized as a "tall" U-stop 198. The U-stop 198 functions so as to provide a stop for the first U-shaped deck 186 when it is lowered into its horizontal orientation. In this position, the tall U-stop 198 rests on the first fork 120 of the forklift truck 102. The U-stop 198 also is free to pivot relative to the first deck 186 so that the U-stop 198 can be appropriately positioned to rest on the first fork 120, while being pivotable so as to be "folded up" when the deck 186 of the first deck assembly 182 is stored in its vertical, retracted position. Turning primarily to FIGS. 1, 4 and 5, the tall U-stop 198 includes a lower bight section 200. The lower bight section 200 extends transversely between an inner leg 202 and outer leg 204. When in the extended position, the legs 202, 204 are vertically oriented. The upper portion of each of the legs 202, 204 is pivotably coupled to a corresponding one of the legs 190, 192 through clevis pin connectors 206.

In a configuration substantially similar to the tall U-stop 198, a short U-stop 208 is associated with the second lower deck assembly 184. With reference to the drawings, the short U-stop 208 also includes a lower bight section 210. The lower bight section 210 extends transversely between an inner leg 212 and an outer leg 214. As with the tall U-stop 198, clevis pin connections 206 are utilized to pivotably couple the legs 212, 214 to the legs 190, 192 of the deck 188.

Figure 7:
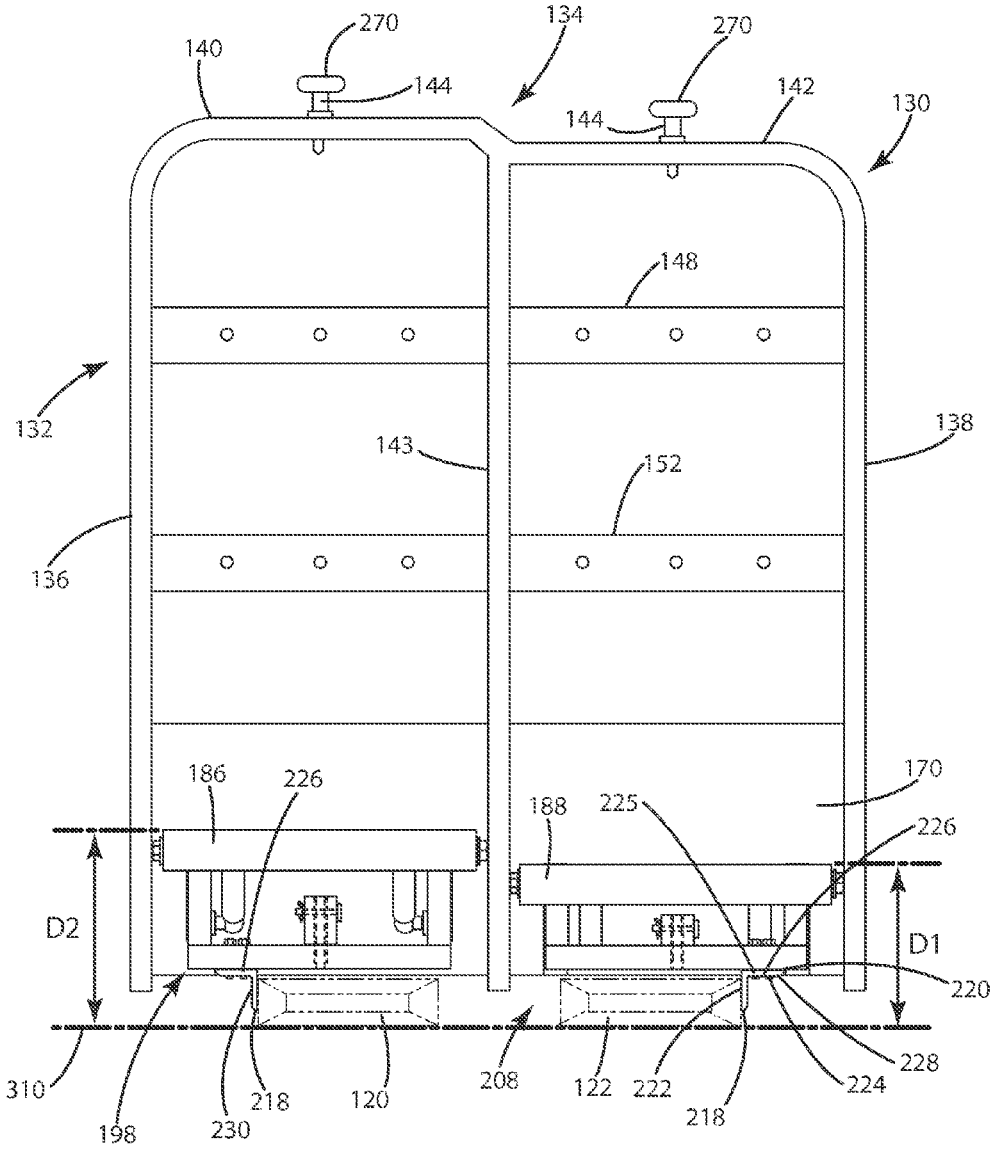
FIG. 7 is a front elevation view of the pallet picking adapter in a substantially standalone format, but showing the forks or tines in phantom line format and further showing the vertical offset of the decks when the decks are both in a vertical orientation.

One particular feature in accordance with the invention will now be noted, with respect to the U-stops 198 and 208. With reference in particular to FIG. 7, the short U-stop 208 includes an anti-shear component 218. As seen in several of the drawings, including FIGS. 5 and 7, the anti-shear component 218 associated with the short U-stop 208 includes an L or U-shaped bracket 220. The bracket 220 has a plate 222 which extends vertically downwardly when the U-stop 208 is in the extended position. The vertical plate is connected to or integral with a horizontal connector plate 224. The connection plate includes apertures 225. Correspondingly, the lower bight portion 210 of the U-stop 208 includes a slot 226. One or more connector bolts 228 are used to secure the bracket 220 to the bight portion 210. The slot 226 allows for selective positioning of the horizontal connector plate 224 along the bottom of the bight portion 210. The horizontal connector plate 224 should be positioned so that the vertical plate 222 abuts or is immediately adjacent to the outer side of the second fork 122.

A similar configuration exists with respect to the anti-shear component 218 associated with the tall U-stop 198. There, the component 218 includes a bracket 230. The bracket 230 is essentially a mirror image of the bracket 220. The bracket 230 includes a vertical plate 232, with a horizontal plate 234 connected or otherwise integral therewith. The horizontal plate 234 includes apertures 225. Correspondingly, the bight portion 200, like the bight portion 210, includes a slot 236. Connector bolts 228 are used to couple the bracket 230 to the bight portion 200. The slot 236 allows for horizontal positioning of the vertical plate 232. As with the vertical plate 222, the vertical plate 232 should be positioned so as to abut or otherwise be immediately adjacent to the outer edge of the fork 120. This configuration is particularly shown in FIG. 7. The purpose for these anti-shear components 218 is to prevent damage to the deck assemblies 180 and other components of the pallet picking adapter 100, in the event of lateral forces being applied to the outer sides of either of the deck assemblies 180. That is, in the event of the application of some type of externally applied force laterally against the outer legs 190 of either deck of the deck assemblies 180, these forces will be translated to the sides of either of the forks 120, 122 as a result of the abutment of the vertical plate 222 or the vertical plate 232 (dependent upon the direction the force is). The forks 120, 122 tend to be substantially rigid and relatively strong, compared to elements of the deck assemblies 180. Accordingly, even with the application of relatively high forces against the sides of the deck assemblies 180, such forces will not tend to cause either of the forks 120, 122 to have any substantial lateral movement. Therefore, lateral movement is also prevented with respect to the deck assemblies 180.

It should be noted that the drawings illustrate one embodiment of the invention with respect to the anti-shear components 218. That is, drawings such as FIGS. 5 and 7 illustrate an anti-shear component 218 as a single component and positioned adjacent to the outer edges of the forks 120, 122. Without departing from the principal concepts of the invention, one, two or even more anti-shear devices 218 may be utilized with respect to either of the U-shaped stops 198 and 208. Further, FIGS. 5 and 7 illustrate the anti-shear components 218 as being positioned adjacent to the outer side of the corresponding fork. It should be emphasized that anti-shear devices 218 can also be positioned on the inner sides of either or both of the forks 120, 122. That is, the principal concepts of the invention are not limited to the use of any particular number of anti-shear devices 218. Also, the anti-shear devices 218 can be positioned on the inner sides and/or the outer sides of the forks 120, 122.

The tall U-stop 198 and short U-stop 208 are both pivotably coupled to the lower portion of the bulkhead 130. With reference particularly to FIGS. 1 and 3, a steel link 238 is provided for coupling the tall U-stop 198 to the bulkhead 130. A substantially identical steel link 240 is utilized to couple the short U-stop 208 to the bulkhead 530. The steel link 238 is connected at a terminal end to the bight section 200 of the tall U-stop 198 through a clevis pin connector 242. Similarly, the terminal end of the steel link 240 is pivotably connected to the lower bight section 210 of the short U-stop 208 through an identical clevis pin connector 242. The opposing ends of each of the steel links 238, 240 are pivotably coupled to the lower portion of the bulkhead 130 (and specifically, the lower plate 170) through a second set of clevis pin connectors 244. The clevis pin connectors 244 can preferably be welded to the lower plate 170.

In addition to the foregoing components, the pallet picking adapter 100 includes a pair of linkage systems 250. The purpose of the linkage systems 250 is to provide for controlled movement of the deck assemblies 186 as the decks 180, 188 and their associated components move between lowered extended positions and vertically oriented retracted or folded positions. The linkage systems 250 are particularly shown in FIGS. 1, 3 and the exploded view of FIG. 5. Turning to these illustrations, the linkage systems 250 include a first linkage system 252 which is associated with the first upward deck assembly 182, and a second linkage system 254 associated with the second lower deck assembly 184. Each of the first and second linkage systems includes a pair of gas springs 256. The function of the gas springs 256 is to control and dampen movement of the deck assemblies 180 when pivotably moving between stored, upright positions and lowered, extended positions. One end of each of the gas springs 256 is coupled to a lower portion of a corresponding pivot block 194. The coupling can be made through a pivot pin 258. One gas spring 256 is associated with each of the pivot blocks 194. Opposing ends of the gas springs 256 are connected to stationery pivot blocks 260 located on the inner sides of the legs 190, 192, 202 and 204 of the deck assemblies 180. Connections of the gas springs 256 are made through pivotable couplings 262.

Figure 10:
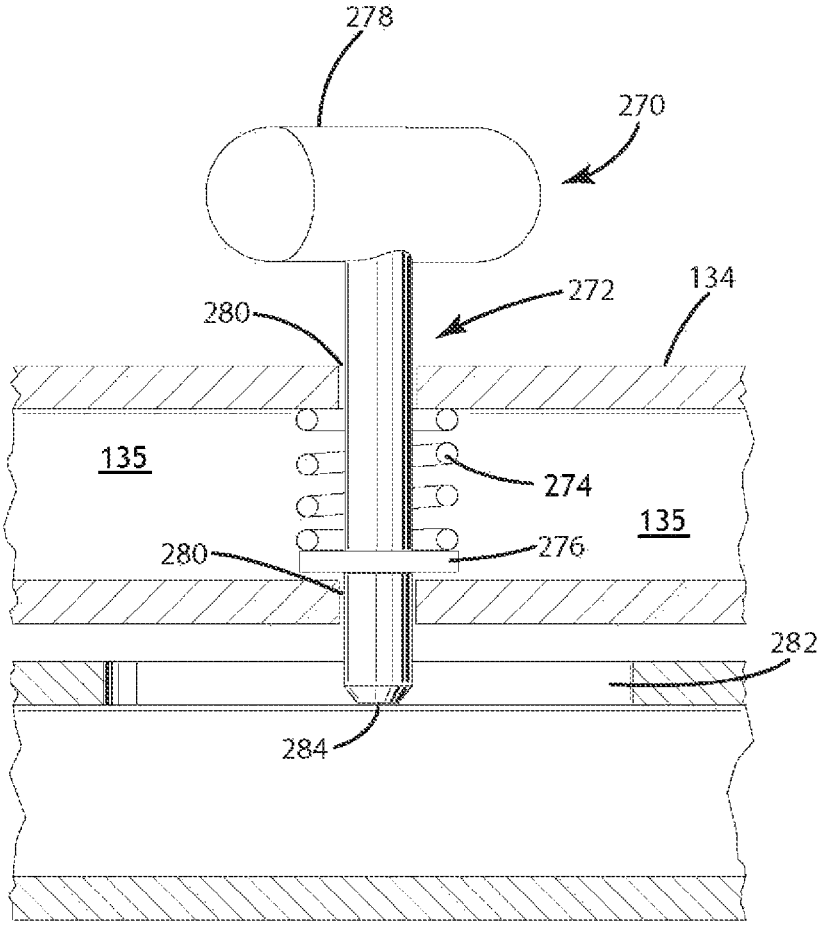
FIG. 10 is sectional view of one of the spring latches which may be utilized to releasably couple a deck to the bulkhead, when the deck is in the vertical orientation.

For purposes of movement of the deck assemblies 180 from the stored to the extended positions, the pallet picking adapter 100 includes a pair of latches 270 which are positioned on the bight half-sections 140, 142 of the upper bight section 134 of the bulkhead 130. These latches 270 are shown with the bulkhead 130 and the deck assemblies 180 in their upright, stored position in FIG. 6. FIG. 10 expressly illustrates the configuration of one of the latches 270. Specifically, the latch 270 includes a spring plunger 272 which extends through an aperture 280 in the bight section 134. In addition to the spring plunger 272, the latch 270 further includes a spring 274 located within an interior of the bight section 134. Captured within the interior 135, and structured so as to surround the spring plunger 272, a spring 274 is provided. The spring 274 is sized and configured so as to be maintained in a compressive state absent the application of any external forces to the latch 270. Positioned at the lower end of the spring 274 is an annular plate 276 positioned between the spring 274 and a lower portion of the bight portion 134. The spring plunger 272 extends through the annular plate 276. The annular plate 276 is fixed to the circumferential surface of the plunger 272. As a further part of the latch configuration, each of the deck assemblies 180 includes a slot 282 formed in the outermost surface of each of the bight portions 193 of the decks 186, 188. When the decks 186, 188 are pivotably rotated to their upright positions, the slots 282 are positioned immediately below the apertures 280 in the bight section 134. In this configuration, the terminal end 284 of the spring plunger 272 (FIG. 10) rests in and is urged against the surfaces of the slots 282, as a result of the forces exerted on the plunger 272 through the compressed spring 274 and annular plate 276. When it is desired to lower either of the deck assemblies 180, the operator can exert lifting forces on the corresponding knob 278. This action will cause the spring 274 to be further compressed and plate 276 to move upwardly. Correspondingly, with the movement of the plate 276, the spring plunger 272 will also move upwardly. This upward movement of the spring plunger 272 causes the plunger 272 to be urged upwardly and out of the slot 282. When the terminal end 284 of the plunger 272 is removed from the slot 282, gravity will cause the corresponding deck assembly 180 to rotate downwardly. With this movement, the gas springs 256 previously described herein will operate so as to "dampen" the movement of the deck assembly 180.

When it is desired to move the deck assembly 180 from their lowered, extended positions into their upright, stored positions, the operator can initiate upward movement of either or both of the deck assemblies 180, and pull the corresponding knobs 278 upwardly so as to allow the slots 282 of the deck assembly 180 to move underneath the terminal ends of the latches 270. When the deck assemblies 180 are in their upright positions, the operator can cease applying forces to the knobs 278, thus allowing the spring plungers 272 to move into the slots 282. In this manner, the deck assemblies 180 are forced to remain upright, until additional forces would be applied which would cause the plungers 272 to be removed from the slots 282.

Figure 15:
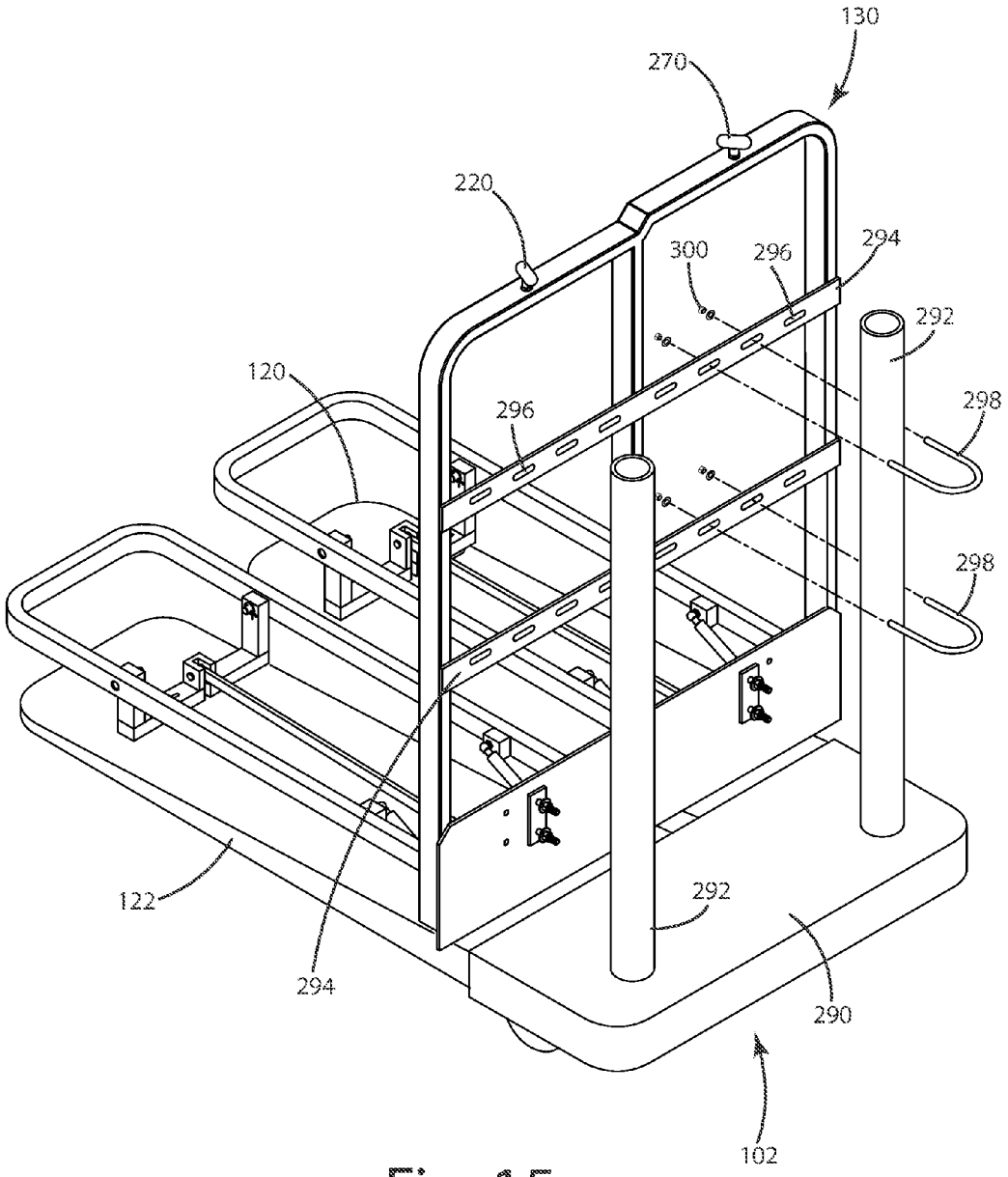
FIG. 15 is a partially exploded view, showing connections of U-shaped bolts for securing rails of the vertical lift frame of the forklift truck to the bulkhead of the pallet picking adapter.

Before describing the functional operation of the pallet picking adapter 100, another means for attaching the bulkhead 130 to the forklift truck 102 should be described. Specifically, FIG. 15 illustrates a partial section of a forklift truck 102, showing an extension base 290 coupled to forks 120, 122. The bulkhead 130 shown in FIG. 15 substantially corresponds with the bulkhead 130 previously described with respect to other drawings. In FIG. 15, the base 290 is shown as having two vertically disposed and upstanding posts or rails 292. The posts or rails 292 can be moved so as to be adjacent to connector plates 294 positioned transversely across the rear portion of the bulkhead 130. The connector plates 294 can include slots or other types of apertures 296. U-bolts 298 and corresponding nuts 300 can be used to capture rails 292 and connector plates 294 for purposes of securing the bulkhead 130 to the forklift truck 102. This configuration can be used in place of or with connector plate configurations previously described herein.

Figure 13:
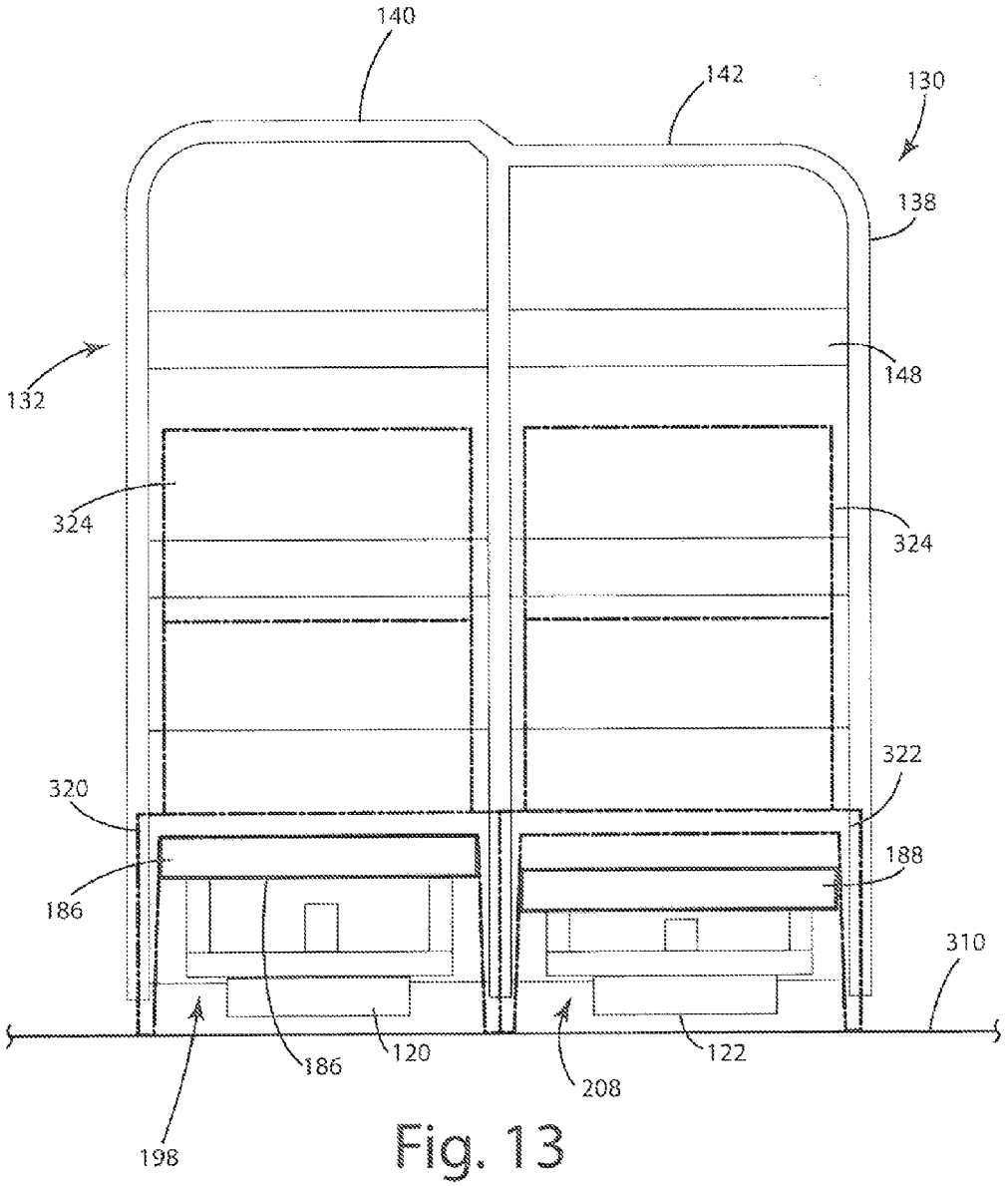
FIG. 13 is a front, elevation view similar to FIGS. 11 and 12, but showing both of the CooLift pallets as resting on the floor surface.
Figure 14:
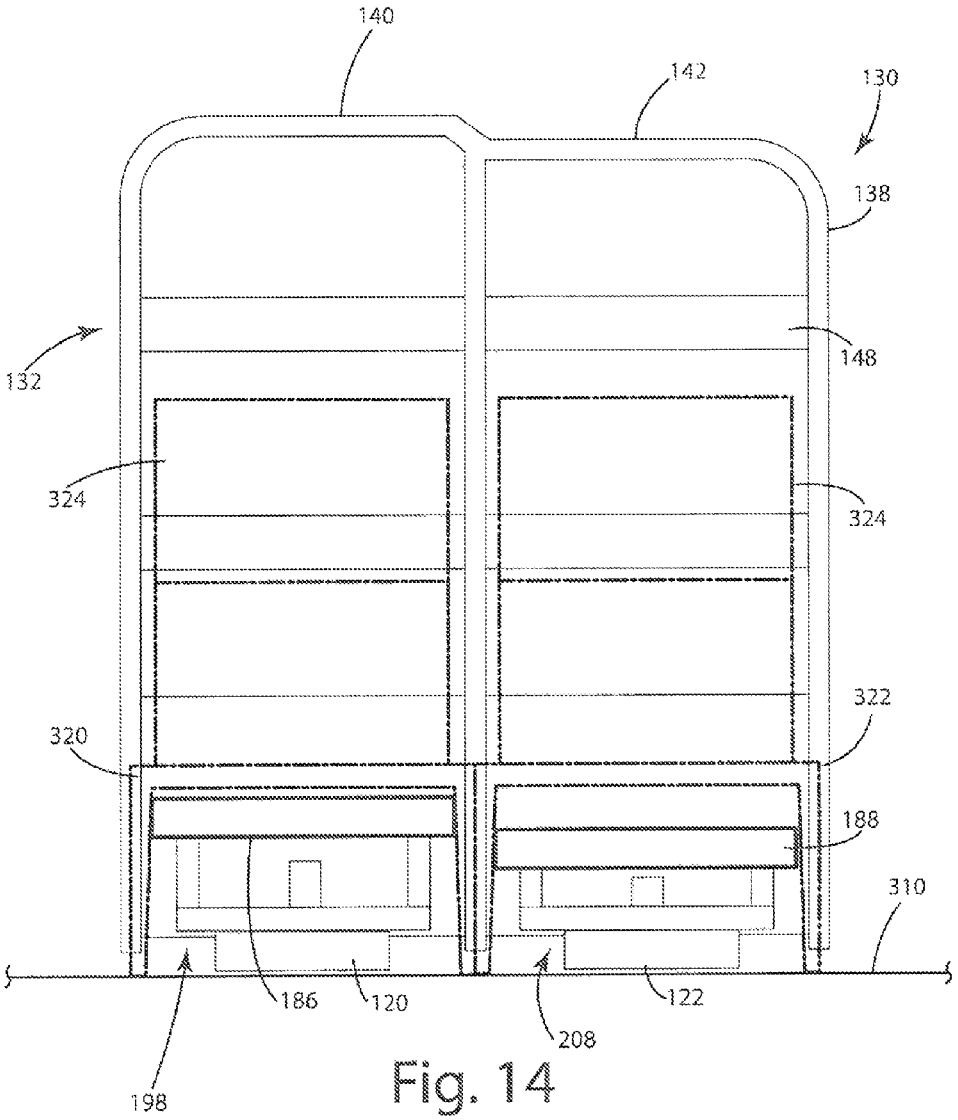
FIG. 14 is a front, elevation view similar to FIG. 13, showing both of the CooLift pallets as resting on the floor surface.

Another feature of the pallet picking adapter 100 in accordance with the invention relates to the relative positioning of the decks 186 and 188 when in their lowered, extended positions. An end view of the decks 186, 188 in their lowered positions is shown particularly in FIG. 7. As apparent therefrom, the decks have a vertical offset. Specifically, deck 186 is positioned a distance D2 above a floor surface 310 (also shown in FIG. 7). Correspondingly, the deck 188, when in the lowered, extended position, is positioned a relatively shorter distance D1 above the floor surface 310. This vertical offset allows flexibility when manipulating one or two pallets on the deck assemblies 180. As an example, the pallet picking adapter 100 may be utilized with a pair of CooLift pallets, each pallet being located on a separate one of the decks 186, 188. An example of the use of the deck assemblies 180 with CooLift pallets is shown with respect to FIGS. 12-14. These figures illustrate the use of the forks 120, 122 and decks 186, 188 with a pair of CooLift pallets shown as CooLift pallet 320 and CooLift pallet 322. The pallets 320, 322 are shown as supporting storage loads 324. As further shown in these illustrations, the deck 186 is vertically offset and above the deck 188. With respect to the pallets 320 and 322, a situation may exist where the operator wishes to remove the pallets from the forklift truck 102 at the same warehouse location. In this situation, when the forklift operator arrives at location, the operator can lower the pallet picking adapter so that both of the pallets 320, 322 rest on the floor surface 310. This configuration is shown in FIG. 14. In this configuration, the pallets 320, 322 can readily be removed from the pallet picking adapter 100 by "backing up" the forklift truck 102.

However, in another situation, the operator may wish to move one of the pallets 320, 322 to a first warehouse location, and move the second one of the pallets 320, 322 to a different warehouse location. If both of the decks 186, 188 were at an equal distance from the floor surface 310, the pallets 320, 322 would both abut the floor surface 310 simultaneously, as shown in FIG. 14. However, with this situation, it would be substantially difficult for the operator to remove one of the pallets from the forklift truck 102 without simultaneously removing the other pallet. It would potentially be necessary for a second operator to assist, and hold one of the pallets stationery on the adapter 100 when the forklift truck 102 is backed up to remove the other pallets.

Figure 11:
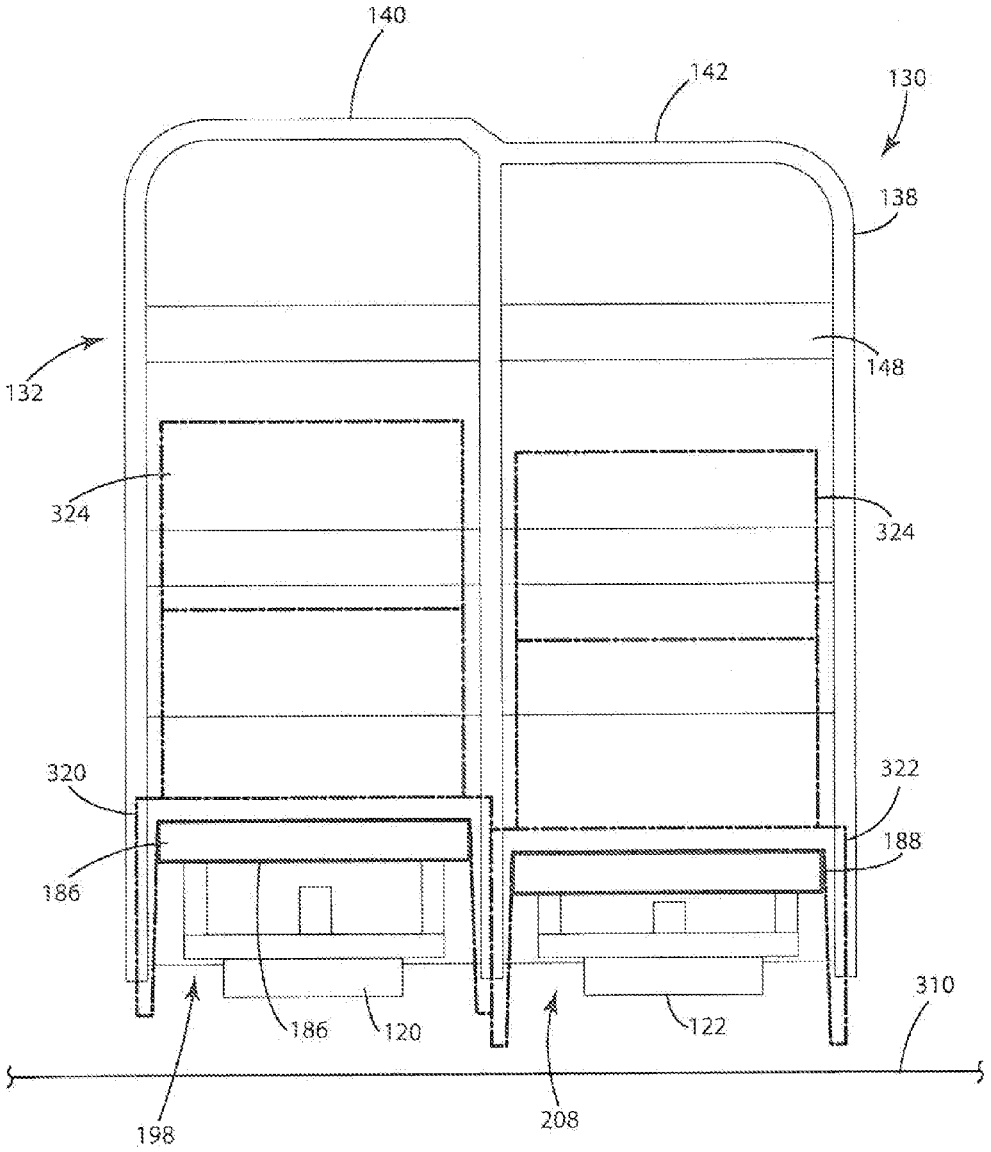
FIG. 11 is a front, elevation view of the pallet picking adapter, showing a pair of CooLift pallets being supported on decks of the adapter assembly, with the CooLift pallets holding storage loads.
Figure 12:
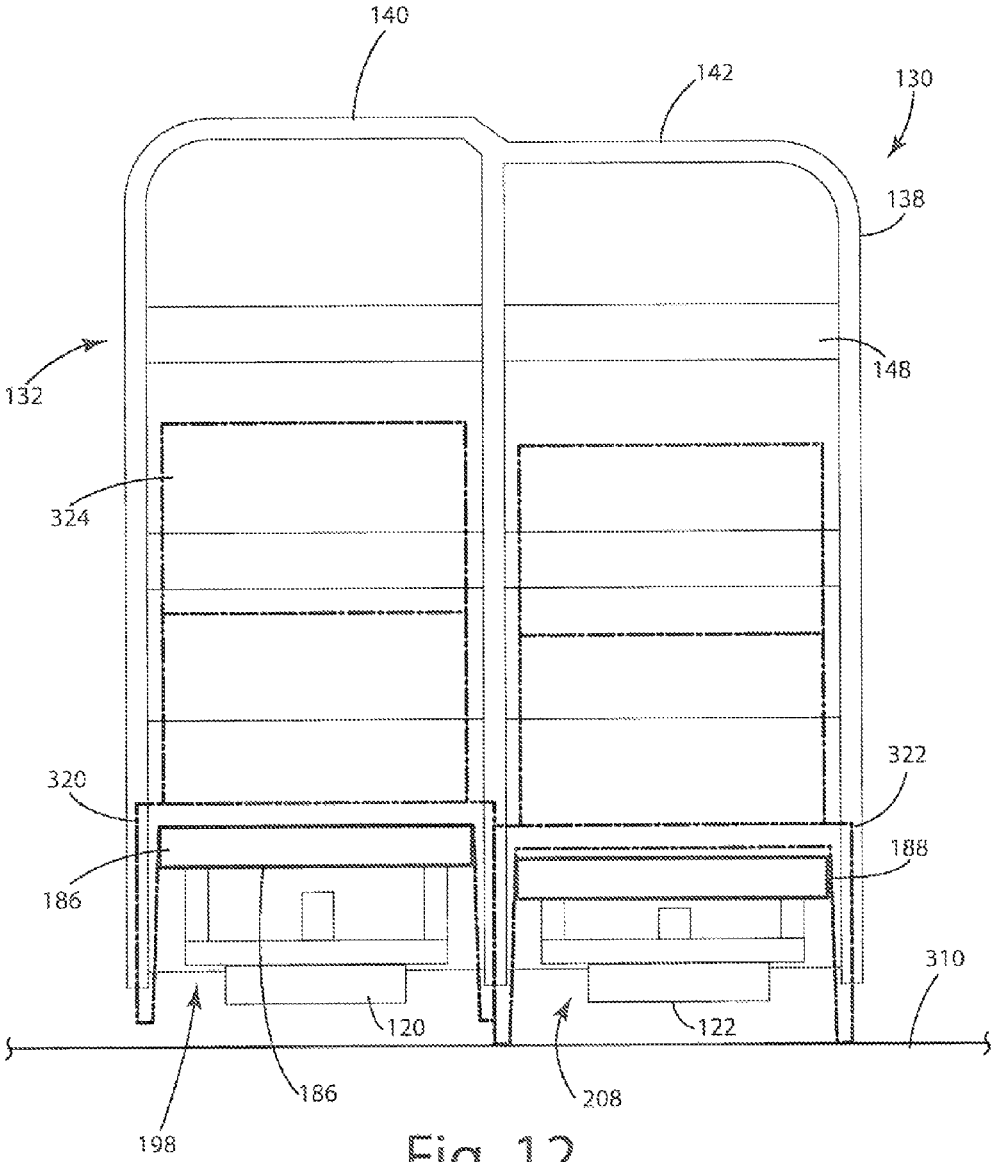
FIG. 12 is a front, elevation view similar to FIG. 11, but showing the CooLift pallet positioned above the lower deck as resting on the floor surface.

Further, however, the concept of using vertically offset decks alleviates this problem. Specifically, if the operator desires to first move and locate the pallet 322, the operator will load the pallet 322 on the lower deck 188. The second pallet to be moved, namely pallet 320, can be advantageously be loaded onto the upper deck 186. Such a configuration is shown in FIG. 11. When the operator has reached the appropriate warehouse location for unloading the pallet 322, the adapter 100 can be lowered to the position shown in FIG. 12, where the legs of the pallet 322 rest on the floor surface 310. It should be noted that in the configuration shown in FIG. 12, the pallet 320 is still positioned above the floor surface level. Accordingly, when the forklift operator backs up the truck 102, only the pallet 322 will be unloaded from the adapter 100. After such operation, the operator can then transport the pallet 320 and its corresponding storage loads 324 to a second location where the pallet 320 is lowered to the floor surface 310, and then unloaded from the forklift truck 102. It should be noted that in the illustrations, FIG. 13 shows a configuration of the pallets 320, 322 and decks 186, 188 similar to that of FIG. 14. However, the heights of the pallets in FIG. 13 are shown as being somewhat lower than those of FIG. 14.

With respect to the advantageous features of the vertical offsets of the deck assemblies 180, it should again be noted that the vertical offset feature is a reason for the U-stop 198 having a greater height than the U-stop 208. The U-stop 198, previously referred to as the "tall" U-stop 198, is utilized with the higher deck 186. Correspondingly, the U-stop 208 referred to as the "short" U-stop 208, is used with the lower deck 188. In addition, it is as a result of the vertical offset feature that the upper bight section 134 of the U-shaped outer frame 132 of the bulkhead 130 includes offset bight half-sections 140 and 142. The bight half-section 140 is slightly raised, relative to the bight half-section 142, so as to accommodate the vertical offset of the decks 186, 188 when they are stored in their upright configurations.

Figure 6:
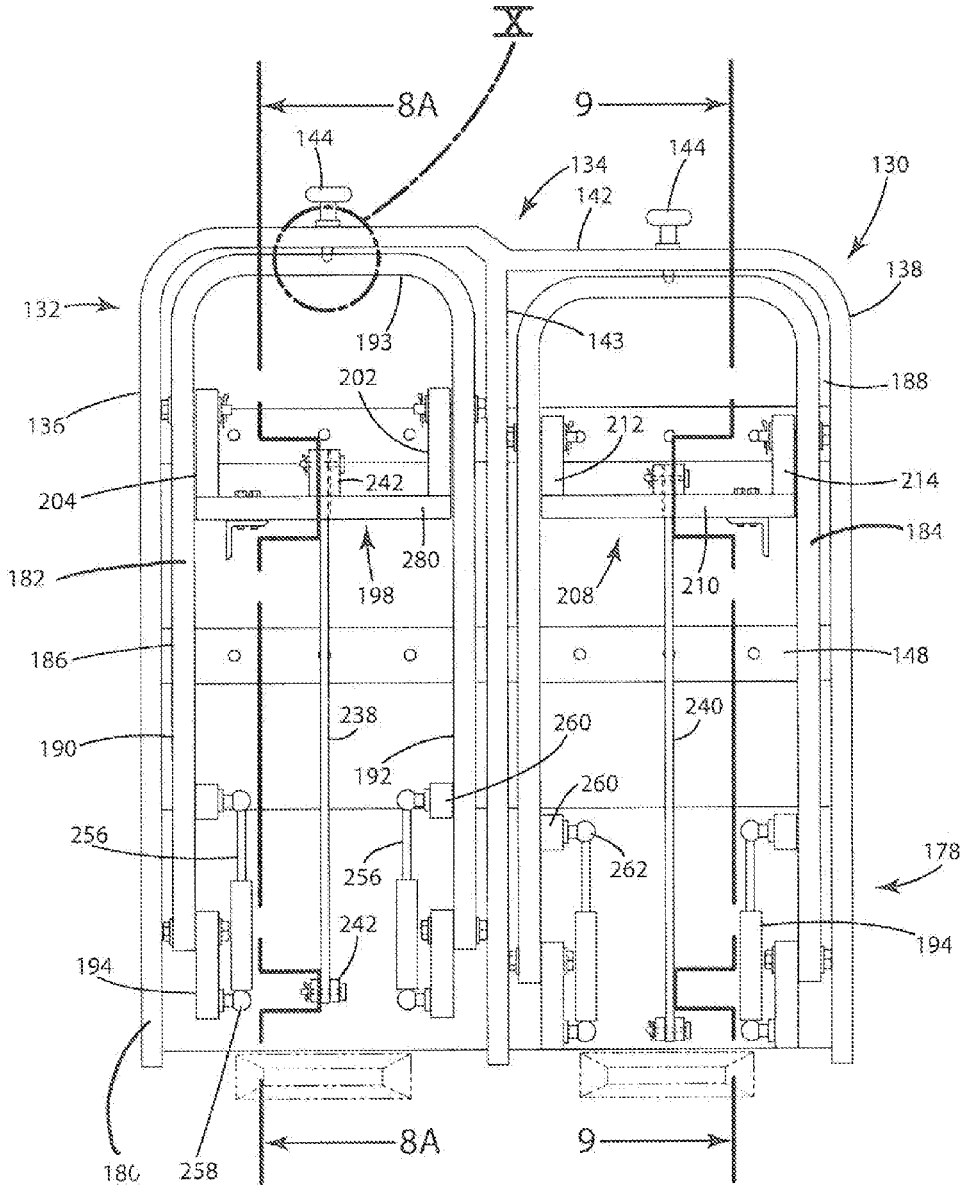
FIG. 6 is a front view of the pallet picking adapter show in FIG. 1, and further showing the forks or tines of the forklift truck in phantom line format.
Figure 8A:
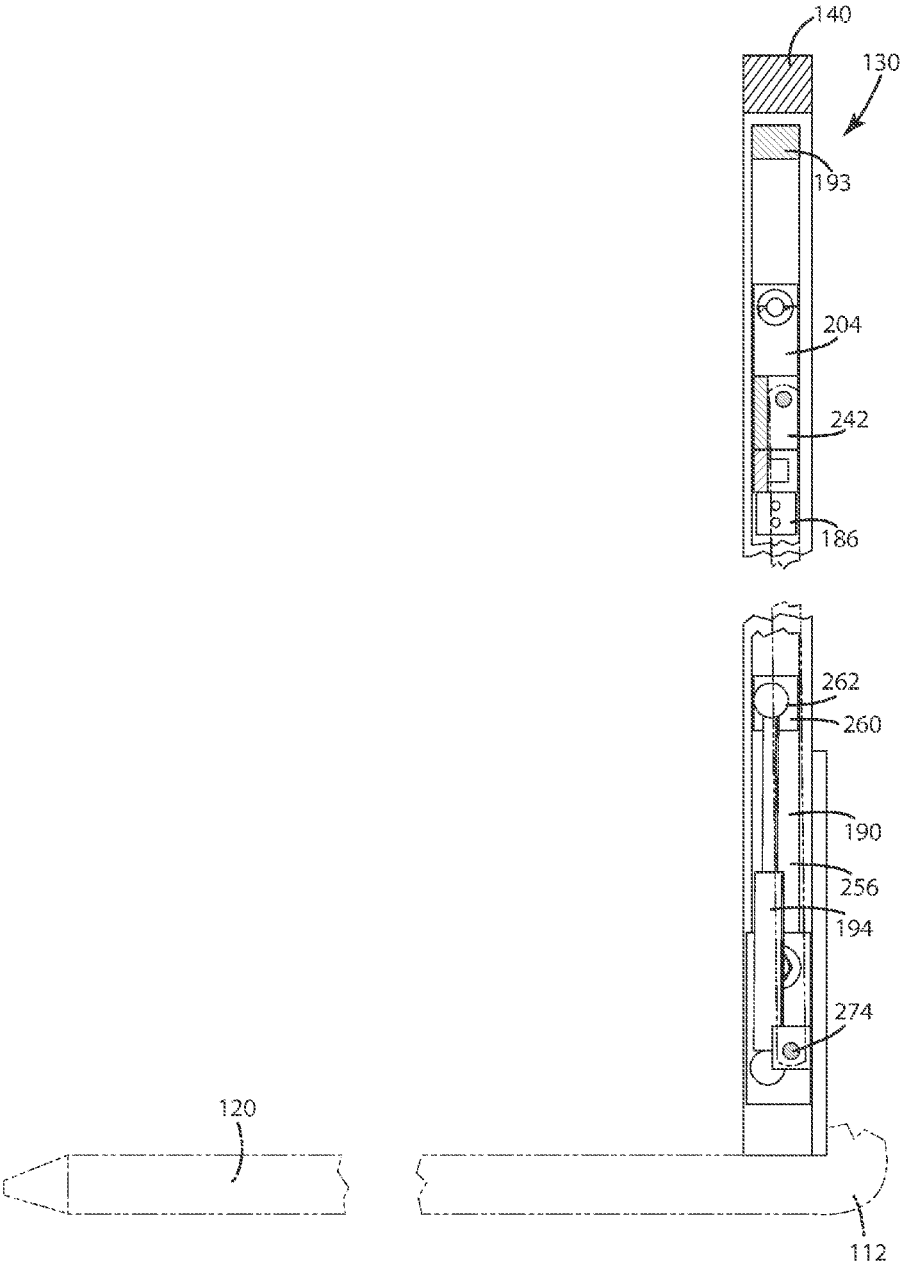
FIG. 8A is a side, sectional view taken along section lines 8-A-8A of FIG. 6, and showing the linkage system and its positioning when a deck is in its vertical orientation.
Figure 8B:
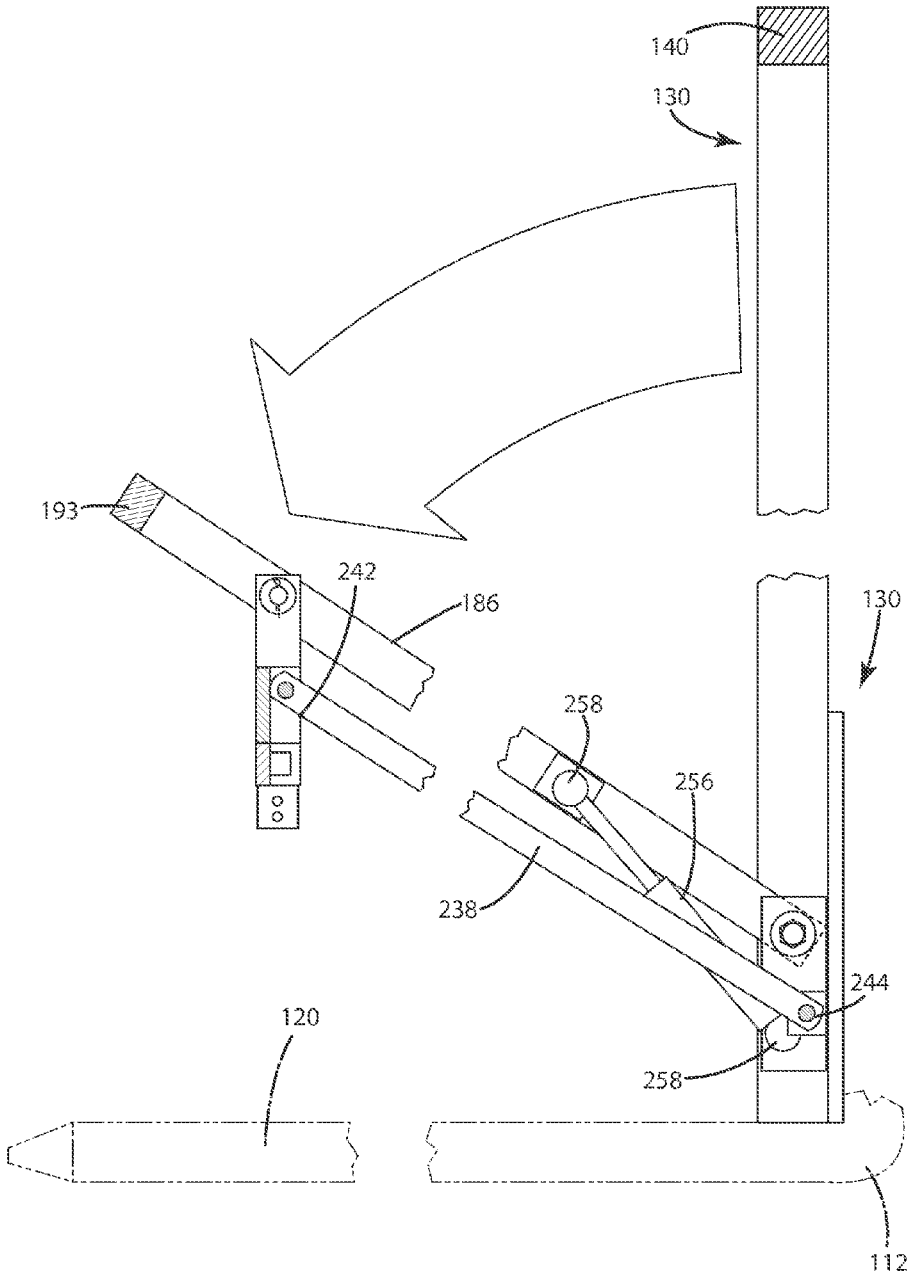
FIG. 8B is a side view of the bulkhead and a deck when the deck is positioned intermediate to and moving from its vertical orientation to its horizontal orientation.
Figure 8C:
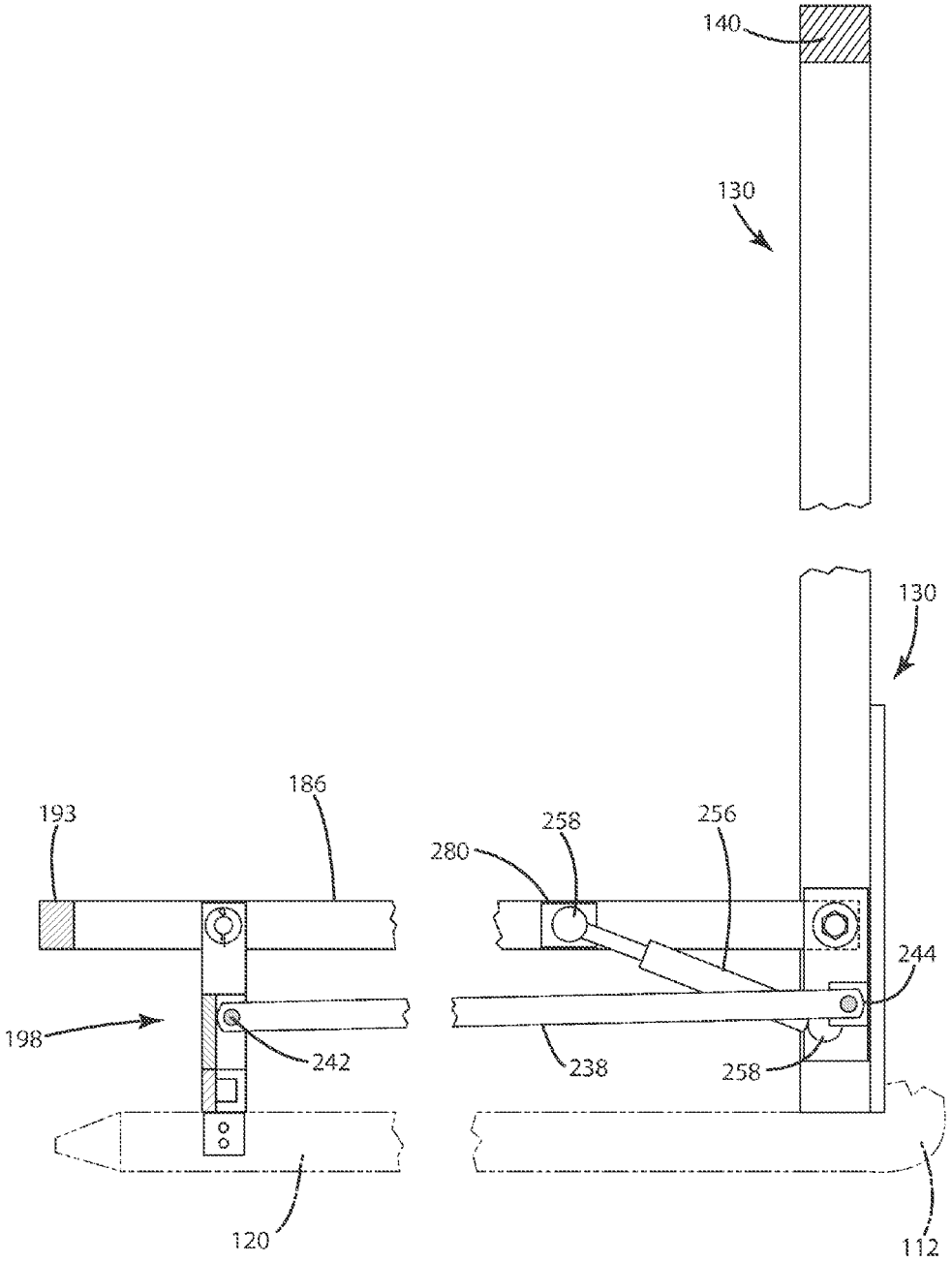
FIG. 8C is a side view similar to FIG. 8B, but showing the positioning of the deck and its linkage system when the deck is in its full horizontal orientation.

The operation of the pallet picking adapter 100 in accordance with the invention will now be described, particularly with respect to FIGS. 6, 8A, 8B, 8C, and 9. FIG. 6 is a front, elevation view of the pallet picking adapter 100 with the deck assemblies 180 in their upright, stored positions. FIG. 8A is a side-sectional view, showing various elements of a section of the first upper deck assembly 182 when in the stored position. When the operator releases the latch 170 associated with the deck assembly 182, the deck assembly 182 will be caused, by the action of the pair of gas springs 256, to initiate downward rotation toward the extended, operable horizontal position. An intermediate position of the deck assembly 182 as it moves through this rotation is shown in FIG. 8B. During this rotation, the gas springs 256 assist in controlling and damping the rotational movement of the deck assembly 182. The deck assembly 182 then further rotates downwardly until the lower bight section 200 of the tall U-stop 198 comes to rest on the upper surface of the fork 120.

Figure 9:
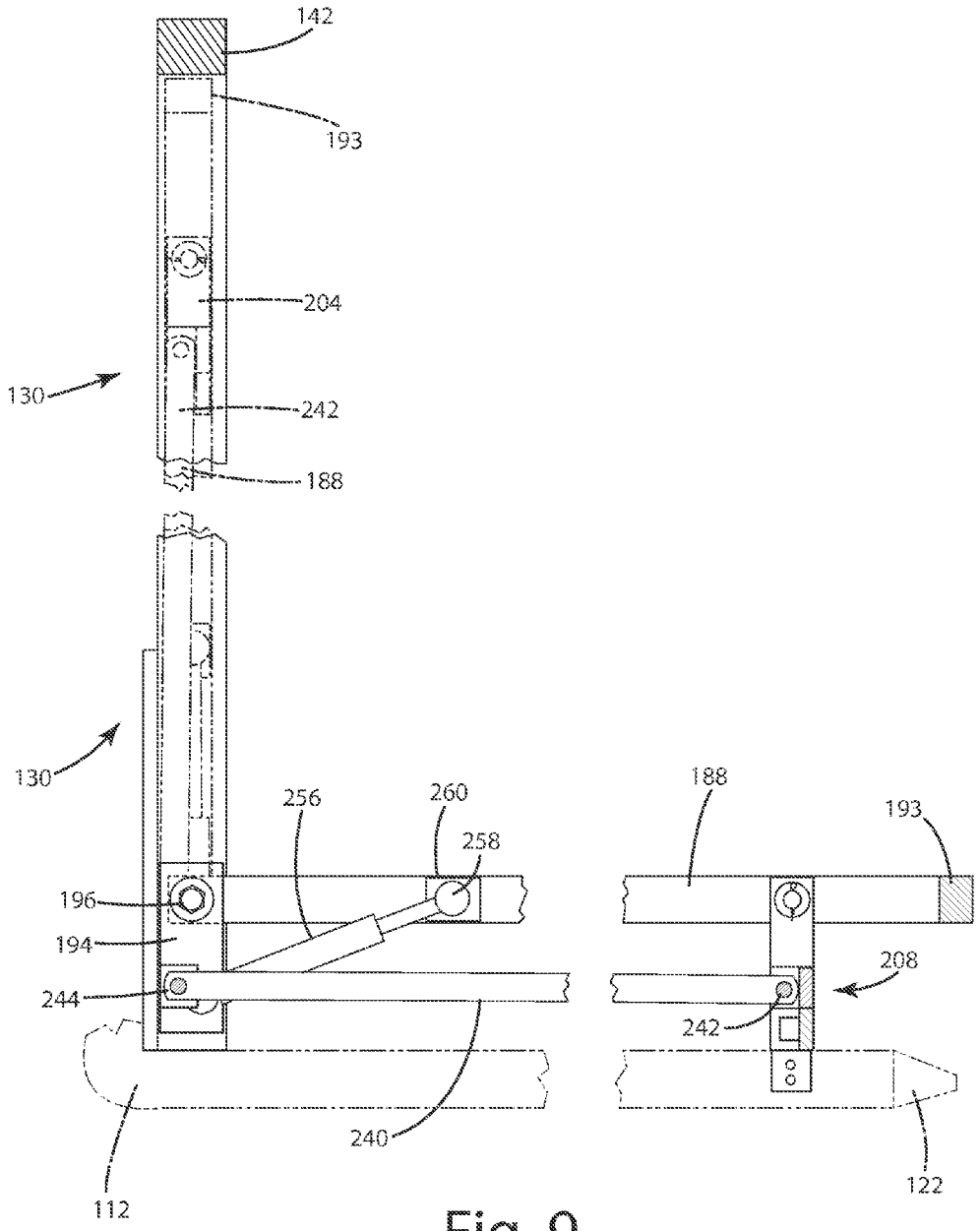
FIG. 9 is also a side, sectional view substantially similar to FIG. 8A, but showing a deck in its horizontal orientation.

Advantageously, the operator can act so as to move either one or both deck assemblies 180 from their stored positions to their lowered extended positions. Operation of the second lower deck assembly 184 corresponds to operation of the first upper deck assembly 182. In this regard, FIG. 9 illustrates a side-sectional view of a portion of the second lower deck assembly 184 when it is in the extended, operable position.

Figure 16:
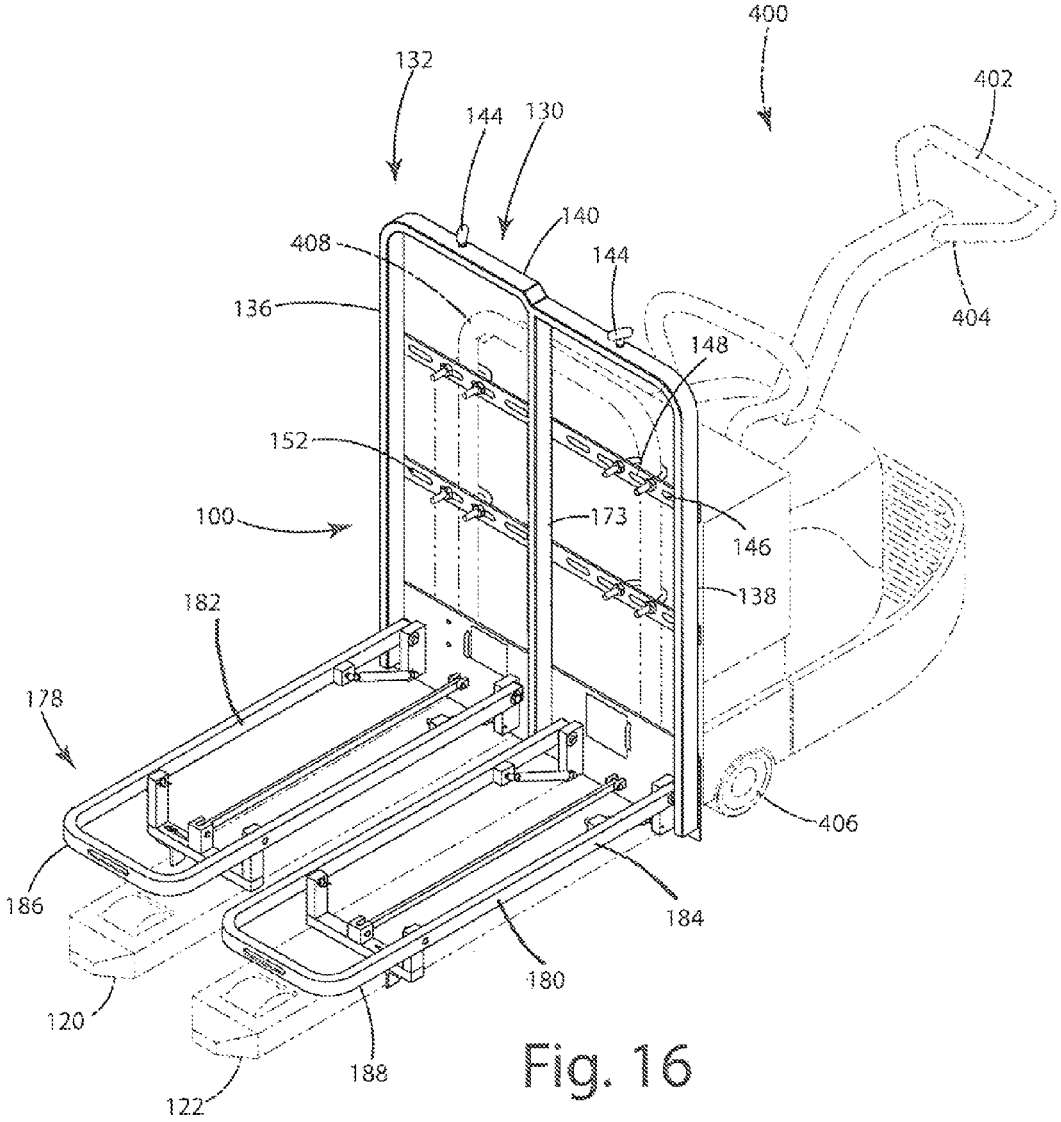
FIG. 16 is a perspective view of the pallet picking adapter illustrated in FIG. 1, but instead of being used with the forklift truck 102, the illustration shows the use of the pallet picking adapter in accordance with the invention with a standard walkie-rider.
Figure 17:
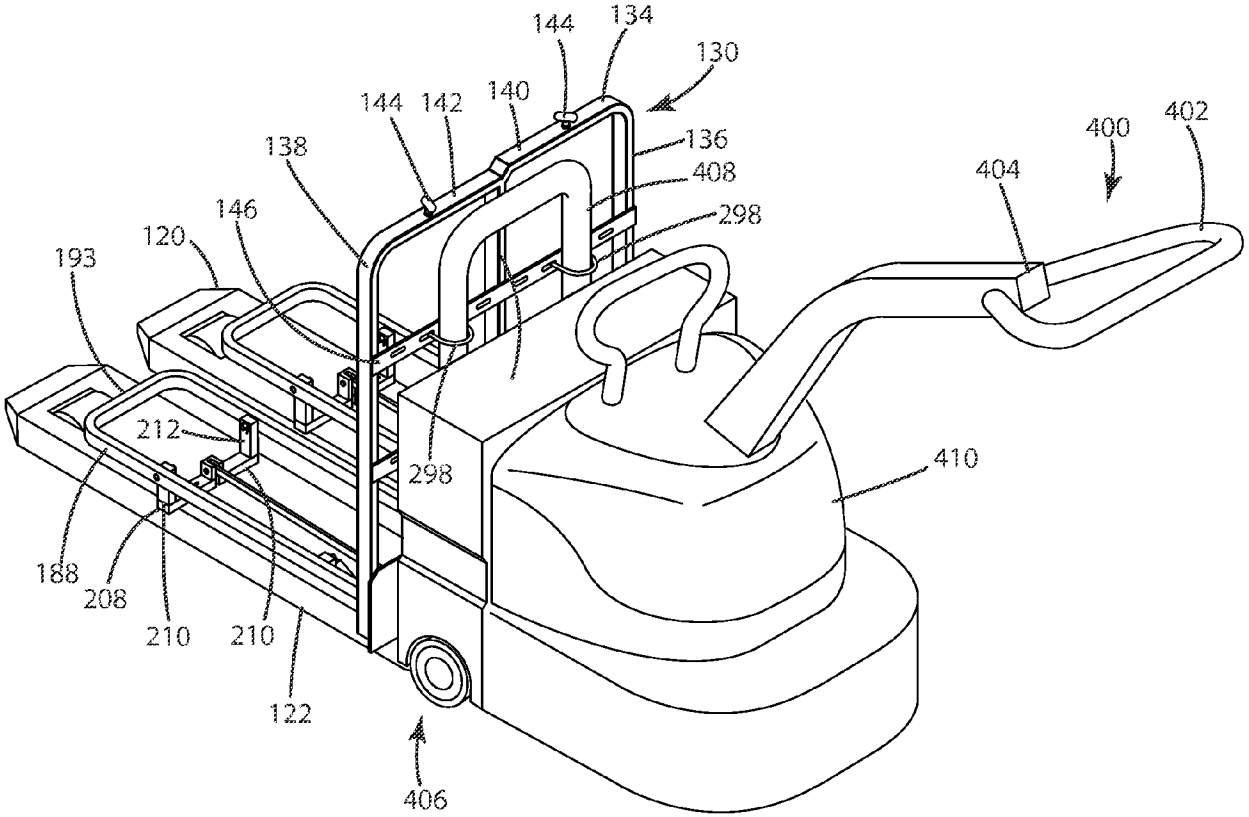
FIG. 17 is a rear, perspective view of the pallet picking adapter being used with the standard walkie-rider as also shown in FIG. 16.

In the foregoing paragraphs, the features of the pallet picking adapter 100 in accordance with the invention have been described with respect to use with a forklift truck 102. As earlier stated, the pallet picking adapter 100 and other adapters in accordance with the invention can be used with various types of forklift trucks. In addition, adapters in accordance with the invention could also be used with other vehicles. One common vehicle used with material handling systems is a walkie-rider. Such a rider is illustrated in an example embodiment as walkie-rider 400 is illustrated in FIGS. 16, 17, and 18, as used with the pallet picking adapter 100. In view of the pallet picking adapter 100, we had previously described with respect to use with the forklift truck 102, individual elements of the adapter 100 as used with the walkie-rider 400 will not be described in repetition herein. The walkie-rider 400 is shown in FIG. 16 in phantom line format as being used with the adapter 100. A rear, perspective view of the walkie-rider 400 is illustrated in FIG. 17. FIG. 18 illustrates a side, elevation view of the walkie-rider 400 and adapter 100, with the deck assemblies 180 being lowered into their extended, operable positions. The walkie-rider 400 can be of a number of different types of vehicles. In the illustration of FIGS. 16-18, the walkie-rider 400 is shown as having a steering control arm. The walkie-rider 400 is further illustrated in the drawings as including a confessional control arm 402, manually operable control panel 404 located on the arm 402, and wheels 406. A lift frame 408 is positioned at the forward portion of the walkie-rider 400, and is attached to the bulkhead of the adapter 100 in the same manner as the previously described forklift truck 102 is attached to the adapter 100. The walkie-rider 400 can also include a main body 410 with an electric motor (not shown) or the like.

As earlier stated herein, the principles of the invention are also disclosed in a second embodiment of a pallet picking adapter 500 as illustrated in FIGS. 19-24. The Applicants believe, at the time of the preparation of this application directed to the invention, that pallet picking adapter 500 incorporates certain concepts which may be considered preferred embodiments of the invention. The pallet picking adapter 100 has been described in detail, and the pallet picking adapter 500 will now be described in the following paragraphs. Many of the elements of pallet picking adapter 500 are identical in both structure and function to corresponding elements of pallet picking adapter 100. Accordingly, such elements of pallet picking adapter 500 will not be described in detail as extensive as the detailed description of the same elements in adapter 100.

As with adapter 100, the pallet picking adapter 500 is designed so as to be used with pallets referred to in the industry as "CooLift Pallets." The adapter 500 is advantageous to use with various types of forklift trucks and walkie-riders, again without need for reconfiguration. The adapter 500 includes manually operable decks movable between lowered or extended positions for use with CooLift pallets, and alternatively maintained in an upwardly folded or retracted position used to transport regular pallets.

Turning specifically to FIGS. 19-24, and particularly FIG. 19, the pallet picking adapter 500 is illustrated as releasably connected to a conventional forklift truck or walkie-rider 502. A walker-rider 502 is specifically illustrated in FIG. 24 in partial view. The walkie-rider 502 may include conventional wheels 510 and a forward position hydraulic hoist arm 512. Extending substantially horizontal and forward of the hoist arm 512 are a pair of forks or tines 518 having an elongated configuration, and shown with relative clarity in FIG. 19. The fork pair 518 may include a first fork 520 and a second fork 522.

As earlier stated, the pallet picking adapter 512 has a number of components corresponding to the pallet picking adapter 100. These previously described components will be briefly mentioned, although again not described in detail. However, adapter 512 also includes certain other new components, or components which have been re-designed relative to the adapter 100. The adapter 500 comprises a bulkhead 530, deck assemblies 580 and linkage systems 650. The bulkhead 530 is primarily shown in FIGS. 19 and 22. The bulkhead 530, like the bulkhead 130 previously described with respect to adapter 100, is a vertical upstanding component which is used to couple the adapter 500 to the truck or walkie-rider 502, and to provide a vertical storage support for the deck assemblies 580 when not in use, as well as to provide a support for pivotal movement and positioning of the deck assemblies 580 in a horizontal orientation when in use.

The bulkhead 530 differs from the bulkhead 130 with respect to several design and structural features. Specifically, the bulkhead height in the adapter 500 has been raised relative to the bulkhead height for the adapter 100. Also, as described subsequently herein, the bulkhead 530 includes a new upper bight section. Also, new transverse bars are positioned below the upper bight section, with the new transverse bars having the latches for releasably capturing the deck assemblies 580. The new transverse bars, like the upper bight section in the adapter 100, includes offset bars.

Specifically, the bulkhead 530 includes an inverted U-shaped outer frame 532 which can be constructed of various types of materials. The inverted U-shaped outer frame 532 includes an upper bight section 534 which extends transversely across the adapter 500. Unlike the upper bight section 134 of adapter 100, which included two offset transverse bars, the upper bight section 534 consists of a single bar extending across the width of the bulkhead 530. Extending vertically downward from one end of the bight section 534 is a first leg 536. A second leg 538 extends vertically downward from an opposing end of the upper bight section 534. The bight section 534, first leg 536, and second leg 538 may be integral with each other.

As a new feature of the adapter 500, a transverse bar group is positioned below the upper bight section 534 and consists of a raised first transverse bar 540 which may be integral with or otherwise coupled at one end to the first side leg 536. The other end of the first transverse bar 540 is welded or otherwise connected to a vertical support bar 541. A second transverse bar 542 extends between the vertical support bar 541 and the second side leg 538 of the bulkhead 530. As apparent from FIGS. 19 and 22, the first transverse bar 540 is raised and offset from the second transverse bar 542. This configuration is used to accommodate one of the deck assemblies 580 being raised and offset from the other of the deck assemblies 580, while maintaining each with the same length as the other. The function of this vertical offset corresponds to the vertical offset function previously described with respect to the upper bight section 134 of the adapter 100.

The support bars 540 and 542 each include a pair of latch assemblies 544. The latch assemblies 544 are located on the support bars 540 and 542. The latch assemblies can include various configurations, including assemblies comprising spring plungers and knobs. The functions of the latch assemblies are to provide releasable and securable coupling of the decks 586, 588 to the bulkhead 530 when in their retracted or unused positions.

For purposes of support and coupling of the bulkhead 530 to the truck or walkie-rider 502, various connector configurations can be used. For example, transverse connector brackets such as the brackets 146 used with the adapter 100 can be provided. Such brackets can be welded or otherwise connected to the rear portions of the side legs 536, 538 and central bulkhead leg or vertical support bar 543. The brackets can include connector brackets located at various heights along the bulkhead 530. The connector brackets can be utilized in conjunction with a series of locking plates, such as the locking plates 158 described with respect to adapter 100. Such plates can have elongated configurations, with apertures extending therethrough. The plates can be constructed so that the apertures therein mate with corresponding apertures located in the transverse connector brackets. However, the apertures may as shown with respect to the apertures 162 in FIG. 5, be in the form of slots rather than circular holes, so as to provide some lateral adjustment of the relative positions of the connector brackets to the locking plates.

Such connector brackets and locking plates can be configured so as to "capture" components associated with the hoist arms 512 of the forklift truck or walkie-rider 502. Alternatively, additional vertical frame components can be located on the vertical portion of the lift frame of the truck or walkie-rider 502. The locking plates can then be positioned relative to the connector brackets so as to capture the frame components. The locking plates and the connector brackets can be secured by conventional bolts and nuts. This type of configuration would correspond to the configuration previously described with respect to adapter 100, and particular shown in FIG. 5. For purposes of clarity, these connector brackets have not been shown in the drawings with respect to adapter 500, although such connector bracket arrangement can be utilized with the adapter 500. Further, however, with other features of the adapter 500, it may be possible to utilize other connection arrangements rather than the connector bracket configurations.

As previously described with respect to adapter 100, the bulkhead 130 included a lower plate 170. The lower plate 170 was shown in FIG. 3. In the adapter 500, a lower plate is also provided, identified as lower plate 570. Relative to the lower plate 170 previously described, the lower plate 570 has a relatively greater height. This is particularly shown in FIGS. 21, 22 and 24. The lower plate 570 is positioned transversely across the bottom of the U-shaped outer frame 532 and is positioned on the side of the bulkhead 530 adjacent to the truck or walkie-rider 502. The lower plate 570 may be welded to the lower portion of the legs 536 and 538, and the central vertical leg 541. However, the lower plate 570 can be secured to the vertical frame of the bulkhead 530 by other suitable securing means.

In addition to the bulkhead 530, the adapter 500 in accordance with the invention includes a deck system 578. The deck system 578 is shown in a number of the drawings, particularly FIGS. 19, 21 and 22. The deck system 578 comprises a pair of deck assemblies 580. The deck assemblies 580 function in substantially the same manner as the deck assemblies 180 previously described herein. The pair of deck assemblies 580 can include a first upper deck assembly 582 and second lower deck assembly 584. When the deck assemblies 580 are positioned in an upright or "folded up" configuration, the truck or walkie-rider 502 can be used to transport regular pallets of various standard sizes and composed of various materials. Conversely, when the deck assemblies 580 are in a lowered position, the truck or walkie-rider 502 can then be used to transport CooLift pallets. If desired, separate pallets can be simultaneously transported onto separate ones of the deck assemblies 580.

The first upper deck assembly 582 includes a first U-shaped deck 586. Correspondingly, the second lower deck assembly 584 includes a second U-shaped deck 588. The decks 586 and 588 are similar to each other, with the deck assembly 586 shown in FIG. 19 in its lowered position, and the deck assembly 588 shown in its upper position. The first U-shaped deck 586 includes a first outer leg 190 extending (when the deck 586 is in the lowered position) from the terminal end of the deck to the bulkhead 530. Correspondingly, the deck 586 also includes a second inner leg 592 extending parallel to the first outer leg 590. A transverse bight portion 593 connects the terminal ends of the legs 590, 592. Correspondingly, the second U-shaped deck 588 also includes a first outer leg 590 and second inner leg 592. A transverse bight portion 593 extends between the terminal ends of the legs 590, 592. The legs 590, 592 of each of the decks 586, 588 are pivotably coupled to the lower portions of the bulkhead 530 through a series of pivot blocks 594. Pivot connector bolts 596 are used to couple the ends of the legs 590, 592 to the blocks 594.

Associated with the deck system 578 and particularly with respect to the first upper deck assembly 582 is a component which is characterized as a "tall" U-shaped stop 598. The U-shaped stop 598 functions so as to provide a stop for the first U-shaped deck 186 when it is lowered into its horizontal orientation. In this position, the tall U-shaped stop 598 rests on the first fork 520 of the truck or walkie-rider 502. The stop 598 also is free to pivot relative to the first deck 586, so that the stop 598 can be appropriately positioned to rest on the fork 520, while being pivotable so as to be "folded up" when the deck 586 of the first deck assembly 582 is stored in its vertical, refracted position.

The tall U-shaped stop 598 includes a lower bight section 600. The lower bight section 600 extends traversely between an inner leg 602 and outer leg 604. When in the extended position, the legs 602, 604 are vertically oriented. The upper portion of each of the legs 602, 604 is pivotably coupled to a corresponding one of the legs 590, 592 through clevis pin connectors 606. In a configuration substantially similar to the tall U-shaped stop 598, a short U-shaped stop 608 is associated with the second lower deck assembly 584. The short U-shaped stop 608 includes a lower bight section 610. The lower bight section 610 extends traversely between an inner leg 612 and outer leg 614. As with the tall U-shaped stop 598, clevis pin connections 606 are utilized to pivotably couple the legs 612, 614 to the legs 590, 592 of the deck 588.

When describing the features of the adapter 100, anti-shear components 218 were described with respect to use of the U-shaped stops 198 and 208. As also described with respect to adapter 100, the anti-shear components 218 prevented damage to the deck assemblies 180 and other components of the adapter 100, in the event of lateral forces being applied to the outer sides of either of the deck assemblies 180.

The adapter 500 also includes anti-shear components. However, the structure and configuration of the anti-shear components used with adapter 500 may be different in configuration. Further, instead of two anti-shear components, the adapter 500 is shown being used with four anti-shear components, one on each side of the U-shaped stops 598 and 608. With the adapter 500, the tall stop 598 includes an anti-shear component 450, and an anti-shear component 452. The components 450, 452 are located on opposing sides of the stop 598 and extend downwardly so as to abut opposing sides of the fork 520. Unlike the anti-shear components 218, the components 450, 452 have a cylindrical configuration. The components 450, 452 are attached at their upper ends to the U-shaped stop 598. As with the anti-shear components 218, the components 450, 452 are adjustable in a lateral configuration so as to compensate for different widths of the fork 520. A similar configuration exists with respect to the short stop 608. With the stop 608, anti-shear components 454 and 456 are positioned on opposing sides of the stop 608. The components 454 and 456 are cylindrical in configuration and extend downwardly so as to abut opposing sides of the fork 522.

It should be emphasized that configurations of the anti-shear components in accordance with the invention are not limited to the specific configuration of the anti-shear components 450, 452, 454, and 456 as illustrated in FIGS. 19, 22, and 23. That is, the adapter 500 can be utilized with one, two or even more anti-shear components positioned on the inner and/or outer sides of the U-shaped stops 598 and 608. That is, any number of anti-shear components can be utilized on either or both sides of either or both stops 598 and 608.

As with the adapter 100, the adapter 500 includes a pair of linkage systems. The linkage systems are identified with respect to adapter 500 as systems 650. These linkage systems essentially operate and are structured similarly to the linkage systems 250 of the adapter 100. The systems 650 include a first linkage system 652 associated with the first upper deck assembly 582, and a second linkage system 654 associated with the second lower deck assembly 584. Each of the linkage systems includes a pair of gas springs 656. The gas springs 656 dampen movement of the deck assemblies 580 when moving between the stored upper position and the lowered, extended position. One end of each of the springs 656 is coupled to a lower portion of a corresponding pivot block 594. The coupling can be made through a pivot pin 658. One of the gas springs 656 is associated with each of the pivot blocks 594. Opposing ends of the gas springs 656 are connected to stationary pivot blocks 660 located on the inner sides of the legs 590, 592, 602 and 604 of the deck assemblies 580. Connections are made through pivotal couplings 662.

For purposes of movement of the deck assemblies 580 from the stored to the extended positions, the adapter 500 includes a pair of latches 670 positioned on the bight transverse bars 540 and 542. Each latch 670 includes a spring plunger 672 extending to an aperture 680 in a transverse bar. Each latch 670 functions in the same manner as the latches 270 previously described with respect to adapter 100. Accordingly, details of the latch assemblies 670 will not be described herein. Instead, we mention that each latch also includes a spring 674 located within an interior of the transverse bar. Captured within the interior 635, and structured so as to surround the spring plunger 272, a spring 674 is provided. The spring 674 is sized and configured so as to be maintained in a compressive state absent the application of any external forces to the latch 670. An annular plate 676 is positioned between the spring 674 and transverse bar. The plunger 672 extends through the plate 676. The plate is fixed to the surface of the plunger 672. When it is desired to lower either of the deck assemblies 580, lifting forces on the corresponding knob 678 can be applied. This will cause the spring 674 to be compressed and plate 676 to move upwardly. Correspondingly, the plunger 672 will also move upwardly. This movement causes the plunger 672 to be urged out of the slot 682. When the end 684 of the plunger 672 is removed from the slot 682, gravity will cause the deck assembly 580 to rotate downwardly.

An additional feature of the adapter 500, relative to the adapter 100, is the addition of a kick plate 470 shown in FIGS. 19 and 20. The kick plate 470 includes a set of vertically oriented slots 472 positioned at various integrals so as to receive various components associated with the deck assemblies 580. As shown in the drawings, the kick plate 470 is located adjacent the bottom of the bulkhead 530, and located in front of the bulkhead 530 opposing the lower plate 570. The purpose of the kick plate 470 is to reduce the likelihood that wooden pallets will get caught up in the pivot blocks. The plate 470 is positioned so as to stop just below the gas springs 656. The kick plate 470 therefore protects the current shock design. Also, in addition to protecting wood pallets, the kick plate 470 prevents the creation of a "catch point" at the outer corner of the adapter 570.

The pallet picking adapter 500 also includes an additional feature relative to the adapter 100, in the form of vertical support brackets 480. The brackets can be in the form of angle brackets as shown in FIG. 21. The vertical support brackets 480 function so as to provide additional strength and rigidity to the back plate 570, while also providing additional protection for elements such as the gas springs 686 and pivot blocks 594. Also, the vertical support brackets 480 can prevent loaded pallets from shifting. The brackets 480 can be welded or otherwise coupled to the lower plate 570.

Another feature of the adapter 500 is the use of a skeleton plate 490. The skeleton plate 490 is a structure which would universally mount to a walkie-rider 502. The skeleton plate 490 is illustrated in FIG. 24. Essentially, the skeleton plate 490 is a means for providing for a universal mounting of the walkie-rider and various forklift trucks 502 to the adapter 500. Also, it should be noted that the skeleton plate and variations thereof may be utilized with previously described connection arrangements for securing the adapter 500 to the truck or walkie-rider 502. Further, although the adapter 500 drawings show a specific number of vertical support bars associated with the bulkhead 530, it should be emphasized that these vertical support bars could be increased in number. The support bars are shown as bars 531 and 533. The number of bars could be increased for purposes of preventing "slide through" of pallets to be transported.

Another feature of the adapter 500 in accordance with the invention relates to the relative positioning of the decks 586 and 588 when in their lowered, extended positions. Specifically, the deck 586 is positioned a certain distance above a floor surface. The other deck 588 is positioned a relatively shorter distance above the floor surface. This vertical offset allows flexibility when manipulating one or two pallets on the deck assemblies 580. Details associated with the offset configurations and the advantageous purposes of the same were previously described with respect to the adapter 100 and the decks 186 and 188. Accordingly, the detailed description of the purposes of the vertical offset will not again be described herein.

The adapters 100 and 500 have been described with respect to particular configurations of forklift trucks 102, walkie-riders 400, and other trucks 502 and other walkie-riders 502. Certain features incorporated within the adapter 500 may be considered to be preferred embodiments, relative to corresponding elements of adapter 100. Further, the adapter 500 includes certain new features as previously described herein, which also could be considered to be preferred embodiments of the invention. It will be apparent to those skilled in the pertinent arts that other embodiments of pallet picking adapters in accordance with the invention can be designed. That is, the principles of pallet picking adapters in accordance with the invention are not limited to the specific embodiments described herein. Accordingly, it will be apparent to those skilled in the pertinent arts that modifications and other variations of the above-described illustrative embodiments of the invention may be effected without departing from the spirit and scope of the novel concepts of the invention.

The invention claimed is:

1. A pallet adapter assembly for use with a pallet transport vehicle having a pallet lifting frame and a plurality of forks or tines for supporting pallets during transport, said pallet adapter assembly comprising:

an adapter frame releasably secured to said transport vehicle, so that said frame moves vertically in conjunction with said pallet lifting frame;

a deck system having at least two deck assemblies coupled to said adapter frame and moveable between first retracted, stored positions, and second, extended operable positions, the deck assemblies being a first deck assembly and a second deck assembly;

said first deck assembly having an first deck having an elongated configuration and positionable on top of a first one of said plurality of forks; and said second deck assembly having a second deck having an elongated configuration and positionable on top of a second one of said plurality of forks when said second deck is in said extended and operable position;

wherein when said first deck and said second deck are both in their extended and operable positions, said first deck is vertically offset from said second deck, so that said first deck is located at a fixed and predetermined distance above said second deck thereby allowing the first deck and the second deck to displace vertically in a fixed relationship; and wherein when said deck assemblies are in said retracted, stored positions, said pallet adapter assembly and said pallet transport vehicle can support and transport standard pallets of conventional sizes.

2. A pallet adapter assembly in accordance with claim 1, characterized in that when at least one deck assembly is in said operable position, said at least one deck assembly is positioned above one of said forks and is adapted to support a pallet during transport.

3. A pallet adapter assembly in accordance with claim 2, characterized in that said adapter frame comprises a bulkhead positioned adjacent said pallet lifting frame of said transport vehicle.

4. A pallet adapter assembly in accordance with claim 3, characterized in that said pallet adapter assembly further comprises a linkage system pivotably coupling each of said first and second deck assemblies to said bulkhead.

5. A pallet adapter assembly in accordance with claim 4, characterized in that said linkage system comprises a first linkage assembly pivotably coupling said first deck assembly to said bulkhead, and a second linkage assembly for coupling said second deck assembly to said bulkhead.

6. A pallet adapter assembly in accordance with claim 5, characterized in that each of said linkage assemblies comprises one or more assist mechanisms for damping pivotable movement of its corresponding deck assembly from said retracted, stored position to said extended, operable position.

7. A pallet adapter assembly in accordance with claim 6, characterized in that said assist mechanisms further facilitate an operator's movement of a deck assembly from said extended, operable position to said retracted, stored position.

8. A pallet adapter assembly in accordance with claim 6, characterized in that each of the assist mechanisms comprises at least one gas spring coupled between a corresponding one of said deck assemblies and said bulkhead.

9. A pallet adapter assembly in accordance with claim 2, characterized in that each deck assembly comprises at least one anti-shear device positioned on said corresponding deck assembly and abutting or otherwise adjacent to a side of the corresponding fork on which said deck assembly rests once said deck assembly is in said extended, operable position.

10. A pallet adapter assembly in accordance with claim 9, characterized in that each of said at least one anti-shear device functions so as to transfer forces applied on at least one side of a deck from potential shearing forces against the deck side to lateral forces applied against the corresponding fork.

11. A pallet adapter assembly in accordance with claim 10, characterized in that at least one of said anti-shear devices is connected to a corresponding one of said deck assemblies so that said at least one of said anti-shear devices is laterally adjustable a predetermined length relative to the position of the deck assembly when in the extended, operable position.

12. A pallet adapter assembly in accordance with claim 2, characterized in that each deck assembly comprises at least one anti-shear device positioned on said corresponding deck assembly and abutting or otherwise adjacent to an outer side of the corresponding fork on which said deck assembly rests when said deck assembly is in said extended, operable position.

13. A pallet adapter assembly in accordance with claim 2, characterized in that each deck assembly comprises at least two anti-shear devices, with at least one of said at least two anti-shear devices positioned on said corresponding deck assembly and abutting or otherwise adjacent to an outer side of the corresponding fork, and another of said at least two anti-shear devices positioned on said corresponding deck assembly and abutting or otherwise adjacent to an inner side of the corresponding fork on which said deck assembly rests when said deck assembly is in said extended, operable position.

14. A pallet adapter assembly in accordance with claim 2, characterized in that:

said adapter frame comprises a vertically oriented bulkhead positioned at a rear portion of said adapter assembly;

when each of said deck assemblies is in a retracted, stored position, the deck assembly is folded into the bulkhead;

said adapter assembly further comprises a latching system for releasably securing said deck assemblies to said bulkhead in their retracted, stored positions.

15. A pallet adapter assembly in accordance with claim 2, characterized in that said latch system comprises first and second latch mechanisms, each of said latch mechanisms being associated with a corresponding one of said deck assemblies and positioned across an upper portion of said bulkhead.

16. A pallet adapter assembly in accordance with claim 1, characterized in that:

said first deck assembly is moveable between said retracted position and said extended position, independent of similar movement of said second deck assembly.

17. A pallet adapter assembly in accordance with claim 1, characterized in that:

said adapter frame comprises a vertically oriented bulkhead;

said transport vehicle comprises frame components positioned adjacent said bulkhead; and said adapter assembly further comprises a connector system for releasably securing said bulkhead to said pallet lifting frame.

18. A pallet adapter assembly in accordance with claim 1, characterized in that said pallet transport vehicle comprises a standard forklift truck.

19. A pallet adapter assembly in accordance with claim 1, characterized in that said pallet transport vehicle comprises a walkie-rider.

* * * * *